US006419574B1

(12) United States Patent
Takahashi et al.

(10) Patent No.: US 6,419,574 B1
(45) Date of Patent: Jul. 16, 2002

(54) ABRASIVE TOOL WITH METAL BINDER PHASE

(75) Inventors: Tsutomu Takahashi; Naoki Shimomae; Tetsuji Yamashita; Hanako Hata, all of Iwaki (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/653,454

(22) Filed: Aug. 31, 2000

(30) Foreign Application Priority Data

| | | |
|---|---|---|
| Sep. 1, 1999 | (JP) | 11-247676 |
| Sep. 1, 1999 | (JP) | 11-247677 |
| Sep. 22, 1999 | (JP) | 11-269298 |
| Oct. 12, 1999 | (JP) | 11-290262 |
| Nov. 29, 1999 | (JP) | 11-338734 |
| Feb. 7, 2000 | (JP) | 2000-029614 |

(51) Int. Cl.[7] ..... B23F 21/03
(52) U.S. Cl. ..... 451/548; 451/443
(58) Field of Search ..... 451/540, 541, 451/546, 548, 56, 443

(56) References Cited

U.S. PATENT DOCUMENTS

| | | | | |
|---|---|---|---|---|
| 3,869,263 A | * | 3/1975 | Greenspan | 51/209 R |
| 6,001,008 A | * | 12/1999 | Fujimori et al. | 451/443 |
| 6,106,382 A | * | 8/2000 | Sakaguchi | 451/443 |

FOREIGN PATENT DOCUMENTS

| | | |
|---|---|---|
| JP | 62-22062 | 2/1987 |
| JP | 5-162080 | 6/1993 |
| JP | 5-285846 | 11/1993 |
| JP | 6-114743 | 4/1994 |
| JP | 7-328937 | 12/1995 |
| JP | 9-19868 | 1/1997 |
| JP | 9-117865 | 5/1997 |
| JP | 9-225827 | 9/1997 |
| JP | 10-58306 | 3/1998 |
| JP | 10-193269 | 7/1998 |
| JP | 10-277919 | 10/1998 |
| JP | 10-286757 | 10/1998 |
| JP | 11-77535 | 3/1999 |

* cited by examiner

*Primary Examiner*—Timothy V. Eley
*Assistant Examiner*—Dung Van Nguyen
(74) *Attorney, Agent, or Firm*—Oblon, Spivak, McClelland, Maier & Neustadt, P.C.

(57) ABSTRACT

In the electrodeposited abrasive wheel 20 of the abrasive tool according to the present invention, plural mound parts 21, which are upheaved at the central domain of base metal 19 in almost columnar shape, are arranged mostly in the shape of lattice. An abrasive grain layer 22 is formed on a base metal 19, and plural ultra abrasive grains 14 are adhered only to each mound parts 21 by electrodeposited metal phase 25, and referred as the small abrasive-grain-layer parts 24, respectively. Ultra abrasive grains are laid out at corner R part 21*a* and top 21*b* of the mound parts 21 at the small abrasive-grain-layer parts 24. Ultra abrasive grains at each small abrasive-grain-layer parts are set as 11–500 pieces, and the rate which ultra abrasive grains occupy to the whole area of abrasive grain layer accounted by plane projection is set as 20%–80% of the range. At the time of grinding, only ultra abrasive grains contact to grinding work piece, then high abutment pressure is maintained, and sharpness and the discharge performance of ground wastes are good.

34 Claims, 25 Drawing Sheets

ABRASIVE TOOL WITH METAL BINDER PHASE

BACKGROUND OF THE INVENTION

1. Field of the Invention

The present invention relates to an abrasive tool with metal binder phase, containing electrodeposited abrasive tool or metal bonded abrasive tool, used for the conditioner for carrying out conditioning of the polishing pad. Which is used for the polishing of the surface of workpiece, for example, a semiconductor wafer with CMP equipment etc.

This specification based on the following Japanese Patent applications (Patent Application number No. 11-247676 (JP), No. 11-247677 (JP), No. 11-269298 (JP), No. 11-338734 (JP), No. 2000-29614 (JP), and the written contents of these concerned Japanese applications are taken in as a part of this specification.

2. Background Art

Conventionally, there is CMP equipment (Chemical-Mechanical Polishing machine) which chemically and mechanically polishes the surface of the semiconductor wafer (henceforth a wafer) cut down from the silicone ingot, and shown in FIG. 32 as an example.

It is required that a mirror polish is carried out so that a wafer may serve as high precision and the zero defect surface in connection with microfabrication of devices. The mechanism of polish by CMP is based on the mechano-chemical polishing method, compounded with the mechanical element by particle silica etc. (free abrasive grain) and the etching element by alkali liquid, acid liquid, etc.

The polishing pad 4, which was attached in the main axis 2 as shown in FIG. 33, and consists, for example, of hard urethane is formed on the disk shaped rotation table 3 at this CMP equipment 1. And wafer carrier 5, which can rotate on its axis, is laid out and attached, oppositely to this pad 4, and also in a position eccentric from the main axis 2 of a pad 4. This wafer carrier 5 is made into smaller disk form rather than the pad 4, and holds a wafer 6. And this wafer 6 is arranged between the wafer carrier 5 and the pad 4, and a mirror polish is offered and carried out to polishing the surface by the side of a pad 4.

Many fine foamed layers are prepared on the pad 4, which polishes the wafer 6 and made of hard urethane etc., for the hold of slurry s. Thereby, polish of the wafer 6 is performed by slurry s held in these foamed layers. Then, the problem arises that the polish accuracy and polish efficiency of wafer 6 falls, because the flatness of the polishing surface of the pad 4 falls or clogging occurs by repeating polish of wafer 6.

Therefore, conventionally, as shown in FIG. 32, the pad conditioner 8 is formed in the CMP equipment 1 and used for re-polish or re-grinding (conditioning) of the surface of a pad 4.

An electrodeposited abrasive wheel 11 is attached to this pad conditioner 8, attached through an arm 10 to the rotation axis 9, which is formed in the exterior of the rotation table 3. By making the arm 10 move around the rotation axis 9, both-way rocking of the electrodeposited abrasive wheel 11 is carried out on the rotating pad 4. Thus, the surface of pad 4 is ground, the flatness of the surface of pad 4 is recovered or maintained, and clogging is canceled. Or it can be ground by the wafer career 5 equipped with an electrodeposited abrasive wheel 11.

As shown in FIGS. 33(A) and (B), as for this electrodeposited abrasive wheel 11, at the upper surface of this wheel, a plane and ring-like abrasive grain layer 13 is formed by fixed width on the disk-formed base metal 12. As shown for example, in FIG. 34, this abrasive grain layer 13 is constituted of ultra abrasive grains 14 on the base metal 12, such as a diamond and cBN, distributed and fixed by the electrodeposited metal phase 15 by electroplating etc. This electrodeposited metal phase 15 consists of nickel etc.

In addition, the concave groove 17 is formed in the surface of the abrasive grain layer 13 in the direction of diameter at intervals of predetermined, such as 45 degrees, then slurry s and ground wastes will be discharged outside through this concave groove 17.

By the way, when pad 4 is ground using such an electrodeposited abrasive wheel 11, the electrodeposited abrasive wheel 11 should be carried out both-way rocking on pad 4, covering the distance equivalent to the radius of pad 4 at least. Nap raising of pad 4 is beaten and cut, while the ultra abrasive grains 14, distributed on the abrasive grain layer 13, carries out grinding. The ultra abrasive grains 14 are protruded from the surface of the abrasive grain layer 13, which performs as grinding surface, only about ⅓ of the mean particle diameter of the ultra abrasive grains 14 in this case. Then, the whole surface of the abrasive-grain layers 13 contact directly to workpiece. For this reason, the abutment pressure disperses and becomes slippery, and nap raising could not be cut and pushed down. Then the fault arises that sharpness becomes worse and clogging becomes easy to occur.

Moreover, the other electrodeposited abrasive wheel is disclosed in the Japanese Patent Laid-Open No., 9-19868 for example.

This electrodeposited abrasive wheel gathers 2–10 ultra abrasive grains, and laid out these grains in the shape of islands. These islands-like ultra abrasive grains are distributed on the surface of the abrasive grain layer, which corresponds to a grinding surface, in order to prevent clogging at the time of grinding, and also to continue grinding for a long period of time. In such an electrodeposited abrasive wheel, masking on a base metal is provided, then island-like priming plating is formed at first. Then, temporary fixation against 2–10 ultra abrasive grains for one-layer is carried out by electroplating at this priming plating part. After that, electroplating of the whole base metal is carried out, and ultra abrasive grains are electrodeposited to an abrasive grain layer.

However, in such an electrodeposited abrasive wheel, ultra abrasive grains are electrodeposited and fixed on a flat base-metal surface. Therefore, the difference of the height between the electrodeposited-metal-phase surface of the abrasive grain layer, and the ultra abrasive grains protruded from this surface, is only less than about ½ of the mean particle diameter of ultra abrasive grains substantially.

Therefore, when this electrodeposited abrasive wheel is used as a pad conditioner. And if grinding work piece has a composition with much elasticity or flexibility as like the pad 4 of CMP equipment 1, which consists of elastic nap raising 1.7 mm in thickness with foamed layer and an under laid cushion layer with a thickness of about 3.5 mm. The whole abrasive-grain-layer surface will make direct contact with grinding workpiece in this case, since the height difference is less than about ½ of the mean particle diameter of ultra abrasive grains. Then, the abutment pressure disperses from ultra abrasive grains and becomes slippery, and nap raising could not be cut and fallen down. Therefore, sharpness becomes worse, and the opening of a foamed layer is crushed, then discharge of ground wastes becomes insufficient. Consequently, there arises a fault that a pad 4 becomes easy to cause clogging.

Moreover, because the height difference (gap) between the ultra abrasive grains at the abrasive grain layer and the surface of the electrodeposited metal phase is small, the grinding liquid (for example, pure water) of pad 4 is flipped out.

Therefore, pad 4 becomes easy to dry and appears a fault that wet grinding becomes spoiled.

SUMMARY OF THE INVENTION

In the view of such circumstances mentioned above, the object of the present invention is to provide an abrasive tool with metal binder phase, such as an electrodeposited abrasive tool, having sufficient sharpness and good discharge performance to ground wastes.

Moreover, the other object of the present invention is to provide an abrasive tool, above-mentioned, which provides clean cut end of the opening of the foamed layer of polishing pad, does not occur clogging, and enables to hold slurry in foamed layer.

The other additional object of the present invention is to suppress vibration at the time of grinding.

The other additional object of the present invention is to suppress the solidification of various grinding wastes and slurry s, retained and staid between ultra abrasive grains, and to enable effective discharge.

The other additional object of the present invention is to improve stability at the time of grinding, and to suppress the fall of the sharpness by clogging etc.

The other additional object of the present invention is to suppress the generation of the deficit or crush, etc. at the sharp portion of ultra abrasive grains.

According to the present invention, one aspect of the abrasive tool with metal binder phase, such as electrodeposited abrasive tool, is characterized by several protruded parts formed in a base metal, and several small abrasive-grain-layer parts, laid out at intervals, to which ultra abrasive grains are adhered with metal binder phase on these protruded parts.

If protruded parts are formed at a planate base metal by electroplating etc. the adhesiveness with a base metal becomes worse, then it arises a fault that flaking is easy to occur. Also, the discrepancy arises, that the protrusions tend to blunt or rises appear at peripheral part by masking. On the other hand, according to the present invention, since the strength of protruded parts is high, flaking or bluntness or rises at peripheral part does not appear.

Moreover, the small abrasive-grain-layer part may be equipped with plural ultra abrasive grains, respectively.

The height difference between the ultra abrasive grains in small abrasive-grain-layer parts and bottom part of the abrasive-grain-layer among small abrasive-grain-layer parts is large, because the ultra abrasive grains are formed in small abrasive-grain-layer parts. And even if the grinding work piece was comparatively elastic, such as pad etc. in CMP equipment, it does not show whole surface contact. And the ultra abrasive grains at small abrasive-grain-layer parts contact and carry out grinding against grinding work piece. Then high grinding pressure can be maintained at ultra abrasive grains, and sharpness is improved. And also, grinding liquid can be held at the bottom of abrasive-grain-layer among the small abrasive-grain-layer parts. Then the discharge of ground wastes is improved and ground wastes do not bring out clogging at the portion of ultra abrasive grains.

Also, it would be possible to make the height from the bottom of abrasive-grain-layer among the neighboring small abrasive-grain-layer parts, larger than the mean particle diameter of ultra abrasive grains at small abrasive-grain-layer parts.

The gap between small abrasive-grain-layer parts at an abrasive grain layer and the bottom of an abrasive-grain-layer, can make larger than the mean particle diameter of ultra abrasive grains, and can be obtained at large value.

Then, without occurring whole surface contact, high abutment pressure can be maintained at the ultra abrasive grains of small abrasive-grain-layer parts, sharpness is also improved. And grinding liquid etc. can be held at the bottom part of abrasive-grain-layer, the discharge performance of a ground wastes is improved, then ground wastes do not bring out clogging at the portion of ultra abrasive grains.

Also, it is possible to form the protruded parts, mostly in the columnar shape with a corner R part and the top part, and ultra abrasive grains can be attached at these corners R part and the top part. At the time of grinding, the ultra abrasive grains at corner R part perform rough grinding, and subsequently, ultra abrasive grains at the top can perform finish grinding.

Also, it is possible, to prepare 11–500 pieces of super abrasive grains at each small abrasive-grain-layer part, and the rate of areas, accounted by plane projection, of the ultra abrasive grains against the whole surface area of abrasive grain layer, may be set in the range of 20%–80%.

If there are few ultra abrasive grains less than 11 pieces, rough grinding and finish grinding to pad 4 cannot be performed continuously, and if there are ultra abrasive grains more than 500 pieces, a fault arises that clogging is easy to occur at the ultra abrasive grains. And if the area of ultra abrasive grains is less than 20%, the possibility arises that those ultra abrasive grains may drop out, at the time of grinding. Then, tool life may be shortened, and ultra abrasive grains may stick to grinding work piece, such as polishing pad, and causes damaging of the pad. And if, the area of ultra abrasive grains exceeds 80%, there is a possibility that an electrodeposited abrasive tool may cause clogging.

Also, it is possible, to layout the small abrasive-grain-layer parts at the central domain except for the peripheral domain of the surface of an abrasive grain layer. Then the rocking of the abrasive tool performs grind machining.

Also, it is possible, to arrange the small abrasive-grain-layer parts at the periphery domain except for the central domain of the surface of an abrasive grain layer. In this case, when rotating the abrasive tool and carrying out grind machining, it can perform efficient grind machining by arranging ultra abrasive grains except for the central domain with small peripheral velocity.

Moreover, according to the other aspect of the present invention, the abrasive grain layer is equipped with a central domain and a peripheral domain, and at the central domain, plural above-mentioned small abrasive-grain-layer parts are formed and set at intervals mutually. And plural ultra abrasive grains are attached to these small abrasive-grain-layer parts by the metal binder phase, respectively. And also, ultra abrasive grains are attached to peripheral domain by the metal binder phase. And the concentration of the ultra abrasive grains at peripheral domain is higher than the central domain.

In this case, at the time of grinding, the grinding surface of the electrodeposited abrasive tool has a peripheral domain with higher concentration of ultra abrasive grains than a central domain. So, the grinding surface contacts to grinding work piece stably by the abrasive grain layer at peripheral domain.

Therefore, plane balance are improved, and the vibration can be suppressed at the time of grinding. Moreover, high abutment pressure can be obtained at the ultra abrasive grain of the small abrasive-grain-layer parts within central domain. Then, while grind machining, cut can be performed cleanly. Moreover, by preparing the ultra abrasive grains at the small abrasive-grain-layer part, the height difference between the bottom of abrasive-grain-layer among the neighboring small abrasive-grain-layer parts and small abrasive-grain-layer parts can be made large. And whole surface contact does not occur, even if it for the comparatively elastic grinding work piece, such as the pad of CMP equipment etc. The ultra abrasive grains at small abrasive-grain-layer parts contact to a polishing work piece and carry out grinding, then high abutment pressure can be maintained and sharpness is maintained.

In addition, the ultra abrasive grains at peripheral domain may be individually distributed in the metal binder phase. Or plural small abrasive-grain-layer parts may be constituted like a central domain, and the small abrasive-grain-layer parts may be laid out at smaller mutual intervals than central domain.

Furthermore, the interval may be made the same as that of a central domain, and make the numbers of ultra abrasive grains attached to each small abrasive-grain-layer part more than that of central domain.

The other aspect of the abrasive tool concerning to the present invention, is characterized by arranging several small abrasive-grain-layer parts, which have the opening for discharging grinding liquid, and forming them approximately in the center.

Since the openings are prepared approximately in the center of a small abrasive-grain-layer part, and supplies grinding liquid to the ultra abrasive grain of the circumference, it can be able to supply grinding liquid directly to the grinding point at the ultra abrasive grain. Then, various grinding wastes are discharged without deposition or accumulations among ultra abrasive grains, and the viscosity of the grinding liquid mixed with the grinding waste is reduced, and discharged smoothly. Furthermore, it can promote cooling of ultra abrasive grains and can also lessen damage.

Moreover, the discharge way may be formed at other domain different from small abrasive-grain-layer parts (protruded part). On both sides of the grinding point at the small abrasive-grain-layer parts, the source of supply and discharge way of grinding liquid are laid out, and distance of them can be shortened as much as possible. Then grinding liquid spreads around at grinding point sufficiently, and prevents to accumulate grinding wastes on ultra abrasive grains, and wash away them smoothly.

Moreover, the diameter of the opening at small abrasive-grain-layer parts may be in the range $\phi$0.5–3.0 mm. If the diameter (d) of the opening is smaller than 0.5 mm, grinding liquid cannot be supplied sufficiently to grinding point. And if it exceeds 3.0 mm it is not desirable, since the existence ratio of small abrasive-grain-layer parts will decrease and grinding capability will decline.

Moreover, the diameter (D) of protruded parts may be 2 to 10 times larger than the diameter (d) of an opening. Then it is possible to prevent deposition of the grinding waste at grinding points and to wash them away smoothly within this limit.

The range of the height of the protruded parts to base metal may be within 0.1–5.0 mm. Grinding liquid and grinding wastes are poured and discharged easily between the discharge ways at base metal and grinding points, if they are within this range.

The range of the distance between adjacent protruded parts (L) may be ⅓~2 time of the mean outer diameter (D) of protruded parts. If it is within this range, the interval of small abrasive-grain-layer parts can be set up pertinently, the abutment pressure of ultra abrasive grains can be maintained at high value, and moreover various grinding wastes can be smoothly discharged with grinding liquid through this gap.

The abrasive grain layer may be formed in the shape of a ring with two or more layers, or in the shape of spiral. Then, the sum of the grinding length of each abrasive grain layer, in the direction almost parallel to the relative movement direction of a grinding work piece, can be made almost uniform at arbitrary position of the direction which intersects almost perpendicularly in the movement direction of grinding work piece. Moreover, if an abrasive grain layer is constituted from three or more layers, the sum of the area of the abrasive-grain-layer domain in the arbitrary position, which intersects perpendicularly in the direction almost parallel to the relative movement direction of a grinding work piece, can be easily made into uniform.

The discharge path may be formed among the abrasive grain layers of two or more layers in the direction of a diameter at intervals. The discharge path may consist of the sub-discharge path formed among the small abrasive-grain-layer parts adjoined each other, and also of main discharge path formed among the plural abrasive grain layers, which are in the shape of a ring or spiral, adjoined each other in the direction of diameter. Various kinds of grinding wastes produced by the grinding in a small abrasive-grain-layer parts are washed away with the grinding liquid supplied from the opening at small abrasive-grain-layer parts, and flows along sub-discharge path. And discharged outside through the main discharge path. Then grinding wastes are discharge easily, and suppress carrying deposition and accumulation among ultra abrasive grains.

Moreover, a single layer of ultra abrasive grains may be adhered to the metal binder phase of the small abrasive-grain-layer part toward the thickness direction, and called as a single layer abrasive tool.

According to the present invention, the abrasive tool with metal binder phase may possess the first small abrasive-grain-layer parts and the second small abrasive-grain-layer parts. The first small abrasive-grain-layer parts incline one directionally against the central line toward the direction of a diameter, and the second small abrasive-grain-layer parts incline to the opposite direction against the first small abrasive-grain-layer parts mentioned above.

Because the first and the second small abrasive-grain-layer parts are prolonged and laid out mostly toward the direction of the center of base metal, the stability of the grinding tool is improved at the time of grinding. The contact surface and contact pressure to the grinding work piece are also stabilized, then minute vibration etc. is suppressed, and grinding work piece is not damaged even at partial area. Furthermore, the first and second small abrasive-grain-layer parts are inclined toward the central line in right and opposite direction respectively, clogging are canceled and fall of sharpness can be prevented in such way. That, considering the relative movement between the grinding work piece and above-mentioned abrasive tools, for example, grinding length of the first small abrasive-grain-layer parts are long and tend to carry out clogging, on the other hand the second abrasive-grain-layer parts have short grinding length.

Therefore, clogging and cancellation of clogging will be performed at micro regions, then the minute vibration at the time of grinding can be suppressed.

Moreover, the first and second small abrasive-grain-layer parts may be different in aspect ratio respectively. Stability is improved, and if an aspect ratio is small, the capability of clogging cancellation will be improved. Moreover, small abrasive-grain-layer parts may be dissociated mutually, and mostly in rhombic shape, and may be arranged in radiation pattern.

Moreover, the first and second small abrasive-grain-layer parts are arranged in the direction of a circumference of base metal in turn, and the abrasive grain layer may be making the shape of a ring. Considering relative movement between the grinding work piece, one of the first and second small abrasive-grain-layer parts may cause clogging because of long grinding length, another can cancel clogging since grinding length is short, then the fall of sharpness can be prevented. Performing clogging and cancellation of clogging in turn at the time of grinding, the minute vibration at the time of grinding can be suppressed, then good sharpness can be maintained.

Small abrasive-grain-layer parts have the portion with one-directionally inclined toward the central line of the direction of diameter passing through the center of a base metal, and the portions which inclines to an opposite direction. Stability at the time of grinding is improved, and minute vibration etc. are suppressed, and moreover, one of small abrasive-grain-layer parts tends to carry out clogging with long grinding length and other with short grinding length cancel clogging, then fall of sharpness are prevented.

Moreover, the small abrasive-grain-layer parts may contain the third small abrasive-grain-layer parts and the fourth smallness abrasive-grain-layer parts, that are formed in the shape of curve and countered on both sides of a central line, faced both sides, or slipped each other along with central line.

The small abrasive-grain-layer parts may be arranged all over the base metal, and can promote increase the amount of grinding much more and also cancellation of clogging.

The other aspect of the electrodeposit abrasive tool at the present invention, small abrasive-grain-layer parts are characterized by a single ultra abrasive grain adhered at the metal binder phase.

Since each ultra abrasive grain is adhered singly on each protruded part, grinding wastes and slurry etc. are not blocked and deposited among ultra abrasive grains, and do not becomes sticky waste, then discharged smoothly.

Furthermore, even if a grinding work piece was elastic like the pad of CMP equipment, whole surface contact doesn't occur and only the single ultra abrasive grain at small abrasive-grain-layer parts carries out grinding.

Therefore, abutment pressure is maintained at high value, sharpness is good, and the discharge performance of grinding wastes is also good.

Moreover, ultra abrasive grain may be adhered at the small abrasive-grain-layer parts formed at the concave parts at the upper surface of the protruded parts of a base metal. If ultra abrasive grains are laid and adhered by electroplate etc. at the concave part of protruded parts on manufacturing of an abrasive tool, then positioning of ultra abrasive grains are easy, and it can be projected and laid so that the corner part of the crystal object of an ultra abrasive grain may turn toward upper part tip. Therefore, grinding performances, such as grinding accuracy and grinding efficiency, are high.

Moreover, the outer diameter (D) of protruded parts may be 1.3 to 3 times as much range as the mean particle diameter of an ultra abrasive grain. Within this limit, it is possible to prevent deposition of the grinding wastes at a grinding point, and to wash them away smoothly. If smaller than 1.3 times, the intensity of protruded parts is weak and ultra abrasive grains will drop out easily by grinding resistance and protruded parts will break easily. If larger than 3 times, the arrangement interval of an ultra abrasive grain becomes too large, and grinding capability will decline or a fault, such as promoting wear of ultra abrasive grains, will arise.

Moreover, the range of the height (H) of the protruded parts to a base metal may be within 0.05–3.0 mm. Within this range, grinding liquid and grinding wastes are poured easily and can be discharged between grinding point and the discharge path on a base metal.

An electrodeposited abrasive tool concerning the present invention characterized by blocky ultra abrasive grains.

Although the sharpness of the ultra abrasive grains with blocky shape is inferior compared with the ultra abrasive grains with irregular shape. Since the blocky ultra abrasive grains have the shape of regular polygons, such as a right hexagon, which the corner part has seldom jutted out, or the shape near form sphere, corner part or ridgeline part, etc. are seldom crushed or drop out, and seldom produces the fragment by crush etc. Moreover it doesn't cut too much at the time of grinding, then seldom produces a scratch at grinding work piece.

Furthermore, even if ultra abrasive grains were blocky, ultra abrasive grains are singly and was mutually distributed, and the small abrasive-grain-layer parts, where plural blocky ultra abrasive grains are gathered and adhered by the metal binder phase, are laid out and distributed mutually. Then the absolute number of an ultra abrasive grain is reduced, and cutting performance and sharpness of a corner part are kept in good condition, if a single ultra abrasive grain is attached at each small abrasive-grain-layer part. Moreover, cutting in and cutting performance are rather good and grinding performance is kept in good condition, because grinding is performed at the ridgeline of the array of ultra abrasive grains around perimeter area, if the ultra abrasive grains are gathered.

Moreover, plural ultra abrasive grains adhere to the small abrasive-grain-layer part, and blocky ultra abrasive grains may be laid out at the perimeter.

Although sharpness is bad at the inside domain of blocky ultra abrasive grains because of the relation with other abrasive grains, grinding machining toward grinding work piece can be carried out in good condition, since the cutting in and sharpness is rather good at the corner part and a ridgeline part at the perimeter side without other abrasive grains. The ultra abrasive grain prepared at each small abrasive-grain-layer parts may be made into 1–500 pieces, and the ratio of the ultra abrasive grains to the whole surface product of the above-mentioned abrasive grain layer accounted by plane projection may be set as 2%–80% of the range.

Moreover, an electrodeposited abrasive tool concerning to this invention may be CMP conditioner.

BRIEF DESCRIPTION OF THE PREFERRED EMBODIMENTS

Hereafter, embodiments of the present invention are explained by the appending drawings, and since the same marks were used into the same portion of the conventional technology mentioned above, the explanation is omitted.

Figure 1:
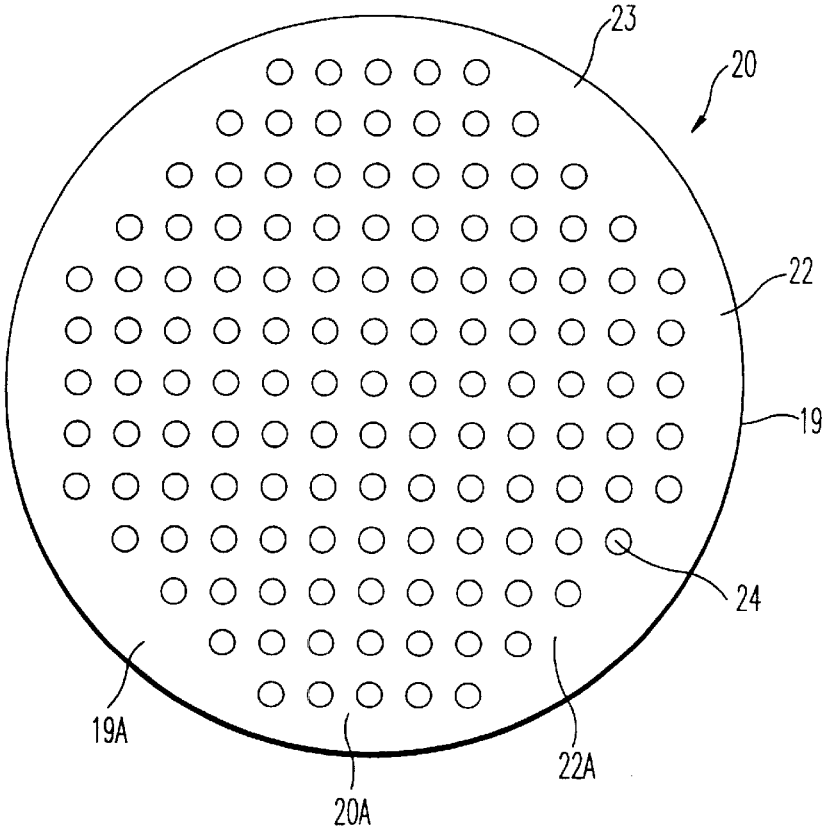
FIG. 1 is a plane view of the polishing surface of the electrodeposited abrasive wheel of the first example of the present invention.
Figure 2:
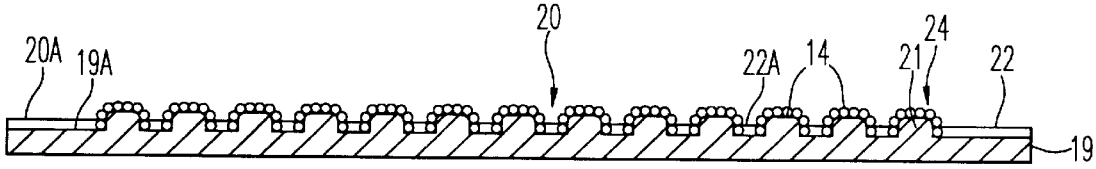
FIG. 2 is a longitudinal section at the center part of the electrodeposited abrasive wheel shown in FIG. 1.

On the electrodeposited abrasive wheel 20 (electrodeposit abrasive tool) shown in FIGS. 1 and 2 as the example of this invention, almost column-like mound part 21 (protruded part)—is formed at intervals of predetermined on one-side of 19*a* of the base metal 19, which is almost round shaped into a disk form and consists of stainless steel etc. An abrasive grain layer 22 is formed at the surface of one-side 19*a,* and the grinding surface 20*a* is formed at the surface. In addition, the mound part 21 is arranged to the central domain in the shape of an almost lattice or meshes, and except for the ring shaped periphery domain 23 at the perimeter of one-side 19*a.*

At the abrasive grain layer 22, the ultra abrasive grains 14, such as a diamond and cBN, are arranged in the electrodeposited metal phase 25 which consists of nickel, for example, and manufactured by electroplating for example. Furthermore, the ultra abrasive grain 14 are adhered only on each mound part 21, and is not prepared at the bottom of abrasive-grain-layer 22*a* among the mound part 21 and the mound part 21. On the mound part 21, the small abrasive-grain-layer part 24 is prepared at the domain of an abrasive grain layer 22, and consists of the ultra abrasive grain 14, which were prepared along the surface almost columnar shaped, and the electrodeposited metal phase 25.

Figure 3:
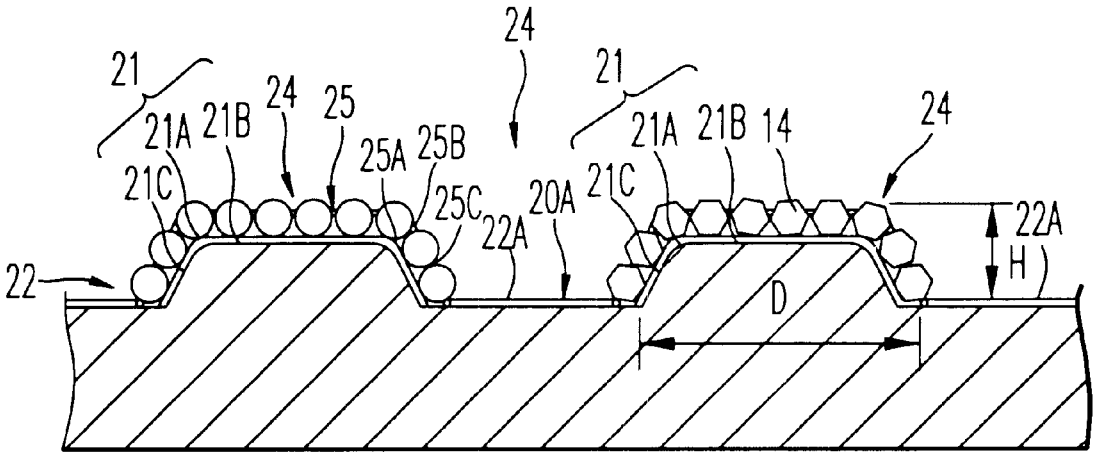
FIG. 3 is a expanded sectional view of the principal part of the small abrasive-grain-layer part of the electrodeposited abrasive wheel shown in FIG. 2. The manufacturing process of the electrodeposited abrasive wheel according to an example of this invention is shown in FIG. 4 as (A), (B), (C), and (D).

At the small abrasive-grain-layer part 24 shown in FIG. 3, each mound part 21 of a base metal 19 is formed by side wall 21*c,* corner R part 21*a,* and top 21*b,* and constituted, for example with the ultra abrasive grains 14 within the ranges of 11–500 pieces adhered by the electrodeposited metal phase 25, on its whole surface. If there are few ultra abrasive grains 14 than 11 pieces, rough grinding and finish grinding to pad 4 cannot be performed continuously. If there are ultra abrasive grain more than 500 pieces, there appears a fault that clogging is easy to occur.

The maximum diameter D of each small abrasive-grain-layer part 24 is taken within the range of ϕ1–10 mm. Height H from the bottom of abrasive-grain-layer 22*a* is taken more than the mean particle diameter of an ultra abrasive grain 14, and taken more than twice of mean particle diameter in desirable case. And the mean particle diameter of an ultra abrasive grain 14 is set less than 1 mm, for example, from 0.1 mm–to about 0.7 mm. Height H was set more than the mean particle diameter of ultra abrasive grain 14, because only the ultra abrasive grains 14 contact to pad 4, at the time of the grinding of a pad 4, and make the bottom of abrasive-grain-layer 22*a* not to contact to pad 4. In addition, each small abrasive-grain-layer part 24 shall be in the same height.

Furthermore, the area of the ultra abrasive grains 14 is set within the range of 20%–80% to the whole surface of polishing-surface 20*a* of an electrodeposited abrasive wheel 20 by plane projection. If the area of an ultra abrasive grain 14 is less than 20%, there will be a possibility that an ultra abrasive grain 14 may drop out, at the time of grinding, and tool life will become short. Moreover, there appears a possibility that ultra abrasive grains 14 stick to pad 4, and damage pad 4. Moreover, if it exceeds 80%, the possibility of clogging appears at an electrodeposited abrasive wheel 20.

The electrodeposited abrasive wheel 20 according to the present embodiment is constituted as mentioned above. Next, FIG. 4 explains the manufacture method of an electrodeposited abrasive wheel 20.

Figure 4A:
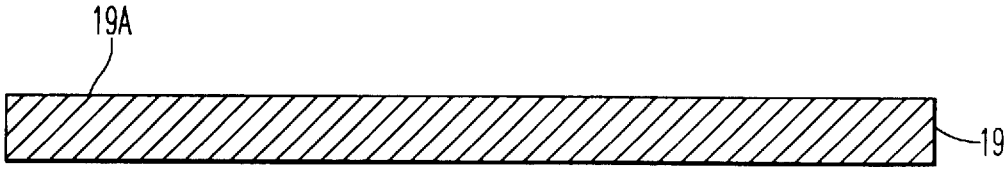
Figure 4B:
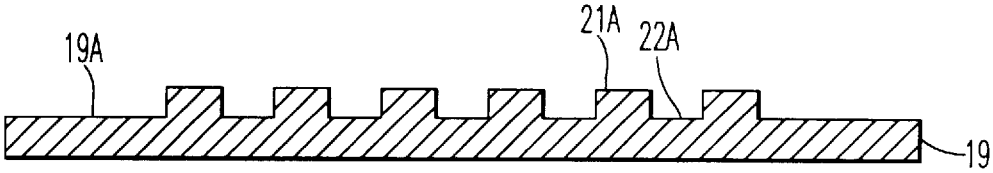

In FIG. 4(A), one-side of the disk formed base metal 19, which is consist of SUS304 etc., 19*a,* is removed by etching etc., and plural mound parts 21A with almost columnar shape are left in the lattice pattern. The portion removed by etching makes bottom part 22A. Sulfuric acid or nitric acid may be sprayed on one-side 19*a* with a high-pressure jet, or by electrolysis etching or electrical discharge machining, then it leaves mound part 21A—specifically and other portions may be carved. Thus, mound parts 21A—shown in FIG. 4(B) are formed at one-side 19*a* with concave convex surface remained in the shape of a lattice. Each mound part 21A becomes into almost columnar shape with predetermined outer diameter D and height H'.

Figure 4C:
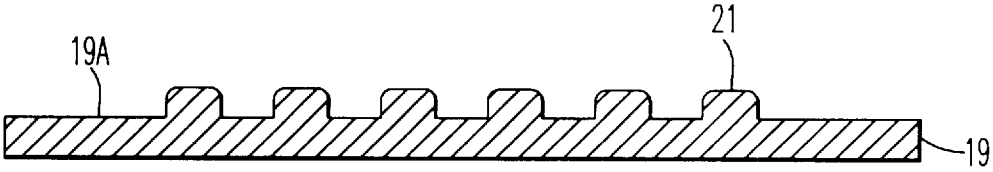
Figure 4D:
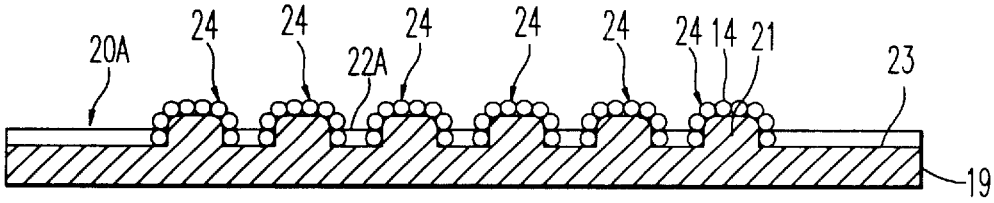

Then, the mound parts 21 are chamfered and formed into almost columnar shape shown in FIG. 4(C) by polishing the edge of each mound parts 21A with the shot blast, barrel polish, etc. on this one-side 19*a*. Or the base metal 19 shown in FIG. 4(C) may be formed by model fabrication.

And if the electroplating of ultra abrasive grains 14 are explained with reference to FIG. 3. Masked except for each mound part 21—, a priming electroplated thin layer is prepared on all over surface of each mound parts 21 as priming electroplated layer 25, consists of nickel (Cu, Cr, etc. are sufficient).

Subsequently, with electroplating, plural ultra abrasive grains 14 are adhered on priming electroplate layer 25*a* by the first electrodeposited-metal-phase 25*b,* which consists of nickel (Cu, Cr, etc. are sufficient). And a masking sheet is stripped from one-side 19*a*. Then the second electrodeposited-metal-phase 25*c,* which consists of nickel (Cu, Cr, etc. are sufficient), for example, is formed on the whole surface with electroplating again. In addition, it is not necessary to form second electrodeposited-metal-phase 25*c* at the bottom part 22A. In this case, the bottom part 22A of base metal 19 is constituted as the abrasive-grain-layer bottom 22*a*.

The ultra abrasive grains 14 are adhered by electrodeposited metal phase 25, which consists of priming electroplate layer 25*a* and the first and second electrodeposited metal phase 25*b* and 25*c*. Then abrasive grain layer 22 is prepared as shown in FIGS. 3 and 4 (D) and electrodeposited abrasive wheel 20 is formed.

In addition, many small abrasive-grain-layer parts 24—were arranged except for the peripheral domain 23 of grinding-surface 20*a* of the electrodeposited abrasive wheel 20, according to the above-mentioned explanation. Arrangement of the small abrasive-grain-layer parts 24 may be carried out at all over grinding-surface 20*a,* without being limited to above example.

Figure 32:
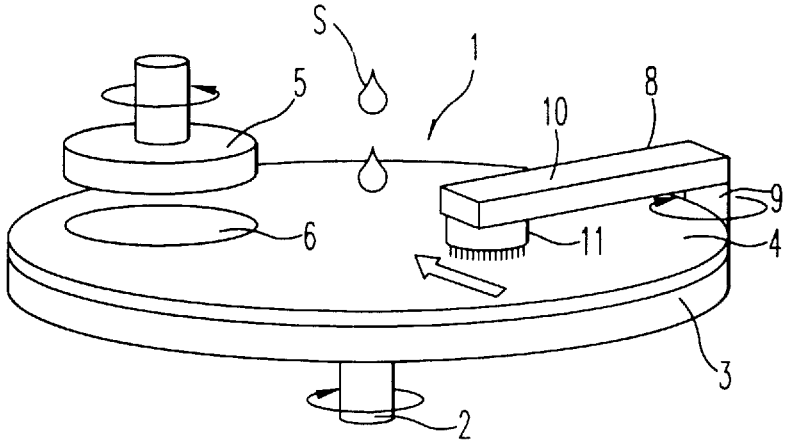
FIG. 32 is a perspective diagram of the principal parts of the conventional CMP equipment.
Figure 33A:
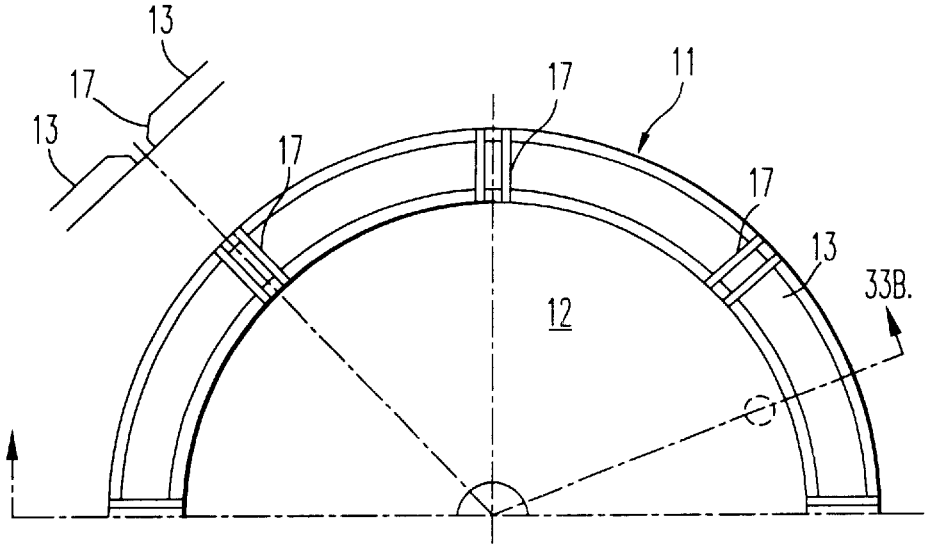
FIG. 33(A) shows a partial plane view of the electrodeposited abrasive wheel in FIG. 32, and (B) shows the longitudinal section at A—A line of (A).
Figure 33B:
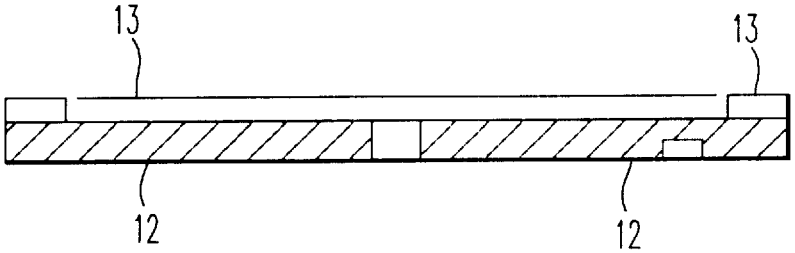

The electrodeposited abrasive wheel 20 according to the embodiment is prepared with above-mentioned composition. With the arm 10 of the CMP equipment 1 shown in FIG. 32 is equipped with an electrodeposited abrasive wheel 20, the arm 10 is rocked, for example, toward the pad 4 on the rotating table 3, when the conditioning of a pad 4 are performed. And both-way rocking of the electrodeposited abrasive wheel 20 is carried out, and the grinding of the pad 4 is carried out, then the flatness is recovered or maintained.

In case of grinding, on each small abrasive-grain-layer parts 24 of the electrodeposited abrasive wheel 20, the ultra abrasive grains 14 at the corner R part 21*a,* perform rough grinding of a pad 4 first. Then, the ultra abrasive grains 14 at the top part 21*b,* which follows corner R part 21*a,* can perform finish grinding. Furthermore, in case of grinding, the ultra abrasive grains 14 are adhered along with corner R part 21*a* to top part 21*b* on the mound parts 21. Then the whole grinding surface of an abrasive grain layer 22 doesn't contact to a pad 4. And since it contacts only with the ultra abrasive grains 14 at the small abrasive-grain-layer parts 24 while grinding, the abutment pressure can be highly maintained at the ultra abrasive grains 14, and sharpness is maintained.

Therefore, the opening of the foamed layer on pad 4 is cut cleanly and an opening is not crushed, then the holding capability of slurry s can be highly maintained. Furthermore, a whole surface contact doesn t occur, then the grinding liquid inside the foamed layer is not wiped out at the time of grinding, then grinding is performed with moisture is included.

Moreover, if a part of the ultra abrasive grains 14 of at corner R part 21*a* of the small abrasive-grain-layer parts 24 was worn out, grinding can be continued by the ultra abrasive grains 14 of the remaining corner R part 21*a,* then the life of the electrodeposited abrasive wheel 20 can be improved.

Furthermore, the bottom of abrasive-grain-layer 22*a* does not contact with pad 4 and pad 4 contact only with the ultra abrasive grain 14 of the small abrasive-grain-layer part 24 at the time of grinding. Then, grinding liquid can held at the bottom of abrasive-grain-layer 22*a* among the small abrasive-grain-layer parts 24, and moreover, ground wastes etc. can be discharged through the bottom of abrasive-grain-layer 22*a*.

Figure 5:
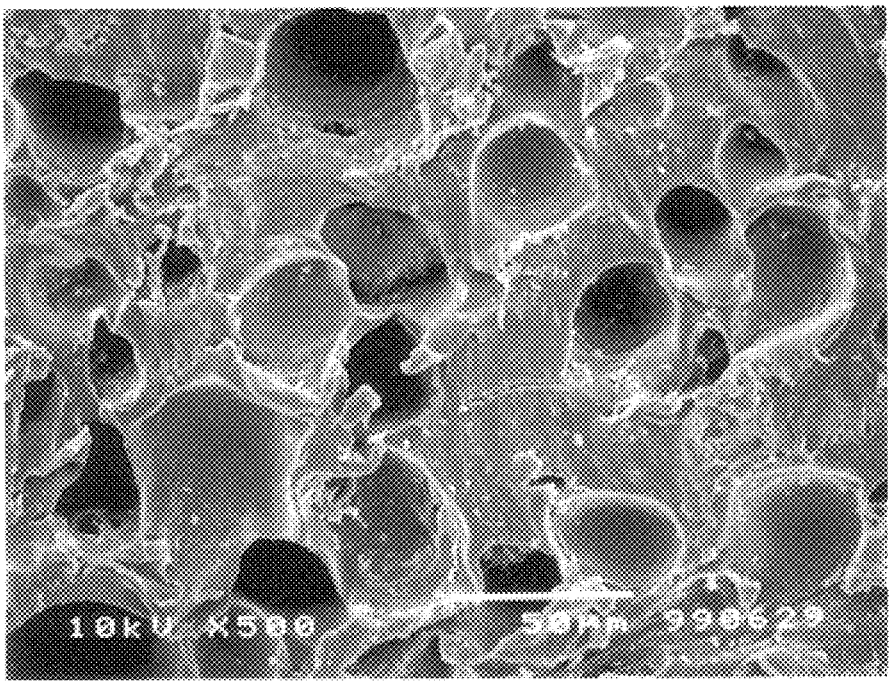
FIG. 5 is a photograph 500 times enlarged showing a part of pad, which carried out grinding by the electrodeposited abrasive wheel of an example of this invention.

Subsequently, the condition of the grinding pad 4 ground by the electrodeposited abrasive wheel 20 according to the present embodiment is shown in FIG. 5. FIG. 5 is a 500 times enlarged photograph of the surface of pad 4. In that figure, the openings k of the foamed layer does not suffer crush, and the grinding of the surface of a pad 4 is carried out cleanly, and the flatness has been recovered.

Thereby, at the time of polishing such as a wafer, the flatness of pad 4 is recovered with the condition where slurry s etc. can be made to pile up enough at the foamed layer of pad 4.

Figure 6:
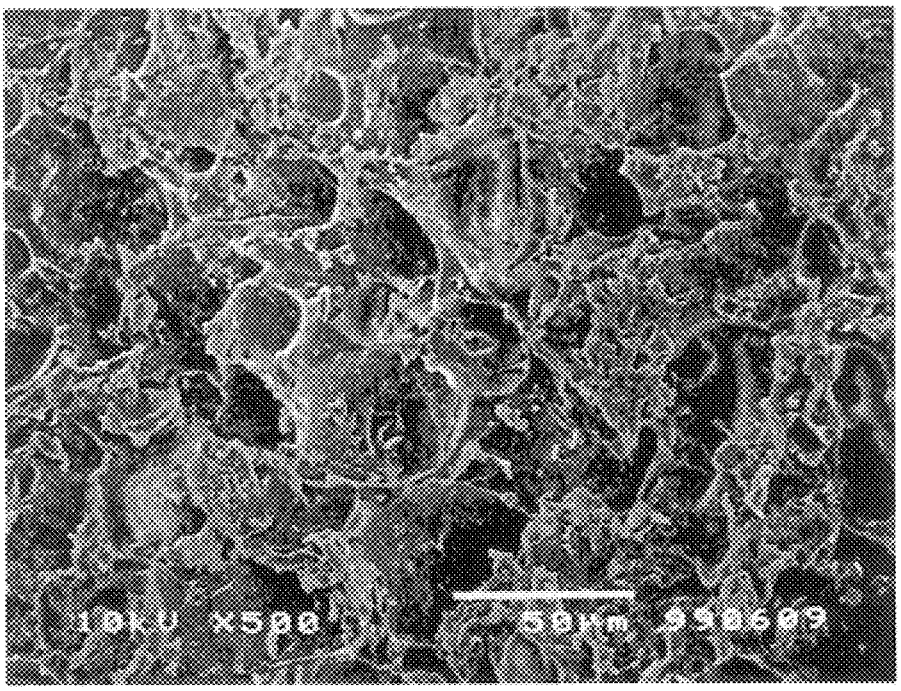
FIG. 6 is a photograph 500 times enlarged showing a part of pad, which carried out grinding by the electrodeposited abrasive wheel which has the composition of the conventional example.

On the other hand, the condition of pad 4 ground by the electrodeposited abrasive wheel with conventional composition is shown in FIG. 6.

Where ultra abrasive grains were made to adhere to the priming electroplate layer on a flat base metal by electroplating, and the height difference at the bottom of the abrasive grain layer was made ½ or less of the mean particle diameter of an ultra abrasive grain. FIG. 6 is a 500 times enlarged photograph of the surface of pad 4. According to this photograph, nap raising of the surface of a pad 4 is beaten, and openings k of foamed layer is crushed considerably and clogging can be seen, because the grinding surface of the abrasive grain layer contact at mostly whole surface. Therefore, the holding capability of slurry s of pad 4 becomes insufficient, and the processability of pad 4 becomes worse.

As mentioned above, according to the present embodiment, the grinding is carried without contacting the bottom of abrasive-grain-layer 22*a*, but the ultra abrasive grains 14 of the small abrasive-grain-layer part 24 contacts pad 4. Therefore, rough grinding and finish grinding can be carried out continuously, abutment pressure is high at ultra abrasive grains 14, sharpness is good, and grinding can be carried out cleanly without crushing the opening of the foamed layer of a pad 4. Moreover, ground wastes does not remain at ultra abrasive grains 14, clogging does not occur and the discharge performance of ground wastes is good. Furthermore, grinding liquid are held among the small abrasive-grain-layer part 24 and bottom of abrasive-grain-layer 22*a*, which is among 24, and wipe out of the grinding liquid at the foamed layer of a pad 4 is suppressed. Then condition of a pad 4 doesn't become dry, and good moisture condition is maintained for wet grinding.

Subsequently, the second embodiment of the present invention is explained by FIGS. 7 and 8. And the same mark is used at the same portion as the first embodiment mentioned above.

Figure 7:
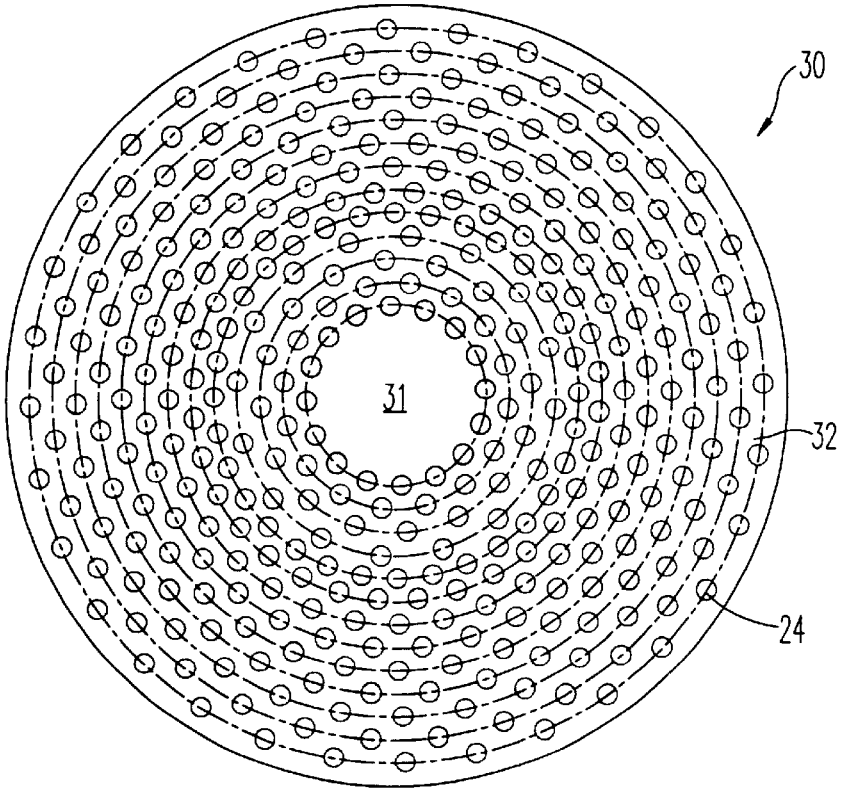
FIG. 7 is a plane view of the polishing surface of the electrodeposited abrasive wheel according to the second example of the present invention.
Figure 8:
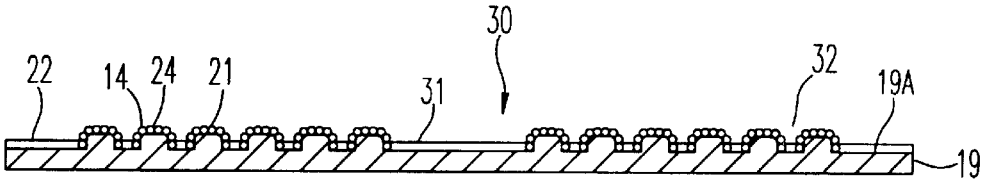
FIG. 8 is a longitudinal section at the central part of the electrodeposited abrasive wheel shown in FIG. 7.

As shown in FIGS. 7 and 8, the electrodeposited abrasive wheel 30 according to the second embodiment, an abrasive grain layer 22 is formed on one-side 19*a* of base metal 19, and the small abrasive-grain-layer parts 24 are not formed in the central domain 31 of abrasive grain layer 22, but two or more layers of small abrasive-grain-layer parts 24—are arranged at the periphery domain 32 in the shape of concentric circle up to the perimeter edge. Many small abrasive-grain-layer parts 24—with concentric circle shape are mutually separated in the direction of circumference, and diameter. The bottom of abrasive-grain-layer 22*a* is arranged among the adjoining small abrasive-grain-layer parts 24.

Furthermore, at the abrasive grain layer 22 on single-side 19*a*, plural ultra-abrasive-grains 14—are adhered only to each smallness abrasive-grain-layer parts 24 with the electrodeposited metal phase 25, respectively.

The electrodeposited abrasive wheel 30 according to the embodiment may be used equipped to the wafer 5, in stead of conditioner 8, and rotated at eccentric position to pad 4 and carrying out grinding of pad 4. In this case, since the central domain 31 of an electrodeposited abrasive wheel 30 has small peripheral velocity and small grinding capability, it is convenient to have not formed the small abrasive-grain-layer parts 24 in respect of grinding efficiency.

In addition, small abrasive-grain-layer part 24—may be laid out spirally at the periphery domain 32, in stead of electrodeposited abrasive wheel 30 according to the second embodiment equipped with small abrasive-grain-layer part 24—in the shape of a concentric circle. Even in this case, the same effect as the second embodiment is acquired. Or the small abrasive-grain-layer parts 24 may be arranged in the shape of lattice or meshes of a net etc. at the arbitrary intervals.

Moreover, the arrangement of these small abrasive-grain-layer parts 24 may be prepared on all over polishing-surface 20*a*.

Moreover, although the small abrasive-grain-layer parts 24 and the mound part 21 were formed in the almost columnar shape according to the embodiment mentioned-above, the form of the small abrasive-grain-layer parts 24 or the mound parts 21 are not limited to this example. They may be in the shape of a convex curved surface, such as the shape of a hemisphere or triangular pyramid form, if the height H from the bottom of abrasive-grain-layer 22*a* is more than the mean particle diameter of an ultra abrasive grain 14.

Subsequently, the third embodiment of the present invention is explained.

The electrodeposited abrasive wheel 120 (electrodeposit abrasive tool) according to the embodiment is the same basic composition with the electrodeposited abrasive wheel 20 according to the first embodiment. The surface of the abrasive grain layer 122 corresponds to grinding-surface 20*a*, and its almost circular central domain is 124, and the ring-like shaped outer domain is the periphery domain 126.

Figure 9:
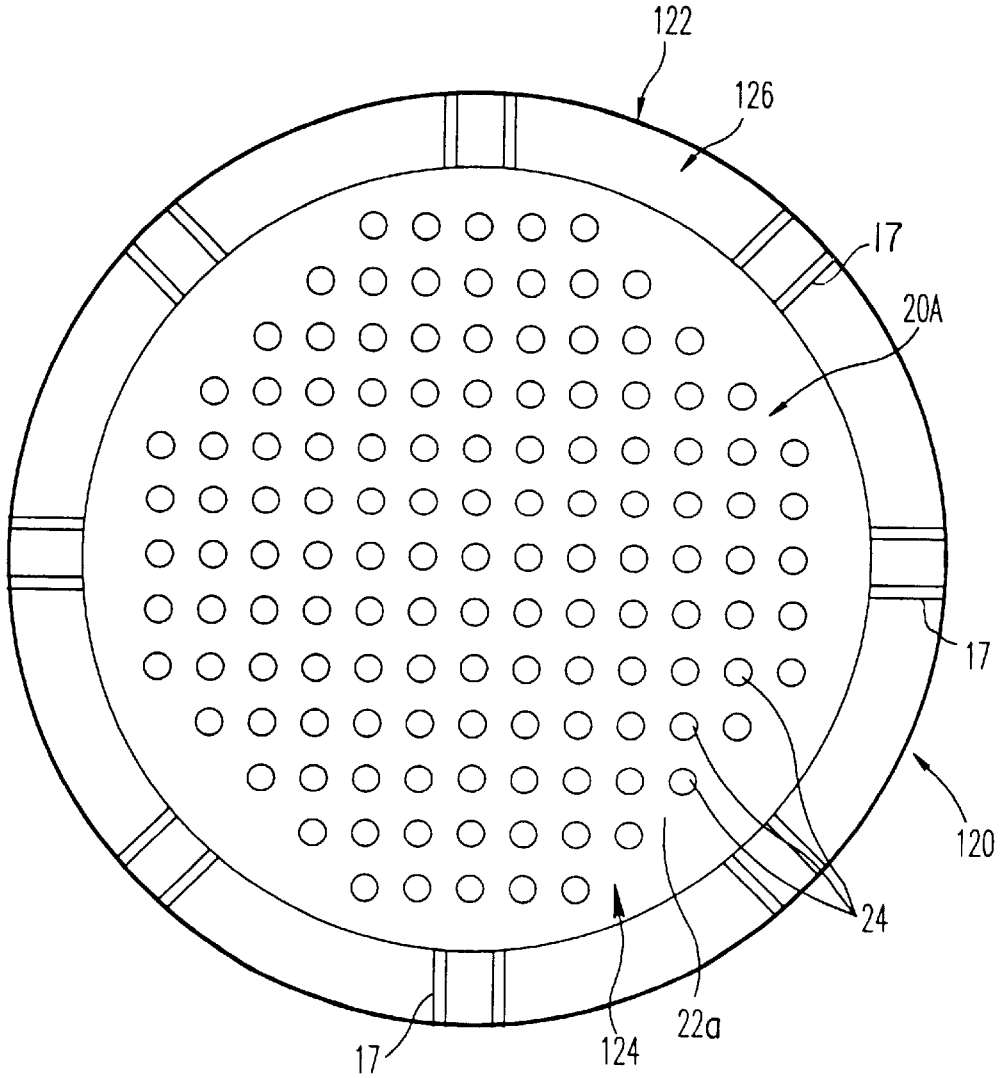
FIG. 9 is a plane view of the polishing surface of the electrodeposited abrasive wheel according to the third example of the present invention.
Figure 10:
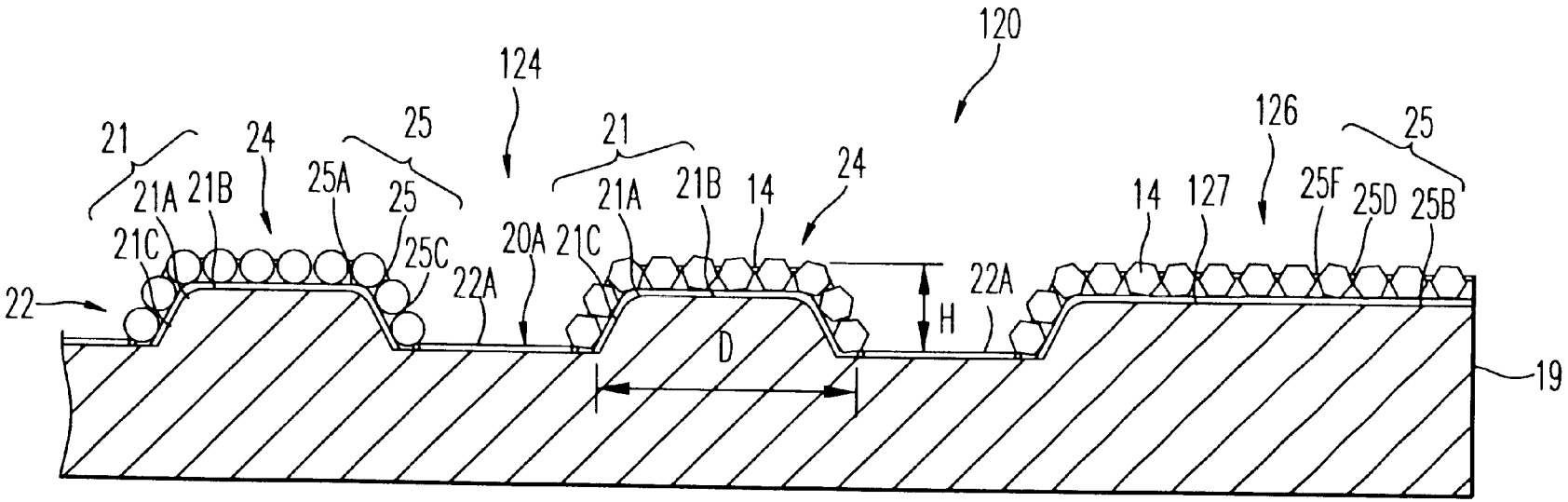
FIG. 10 is a partial expanded sectional view of the central domain and the peripheral domain of the electrodeposited abrasive wheel shown in FIG. 9.

At the one-side 19*a* of the base metal 19 shown in FIGS. 9 and 10, plural mound parts 21—with almost columnar shape are arranged at the central domain 124 in the shape of lattice, or meshes with predetermined intervals. The convex plane part 127 with ring-like flat plane, whose width is about 3 mm, is formed at the periphery domain 126. The height of the convex plane part 127 is set as the same with mound part 21—.

At the central domain 124, as for the abrasive grain layer 22, plural ultra abrasive grains 14 are adhered by the electrodeposited metal phase 25 only on each mound part 21. The bottom of abrasive-grain-layer 22*a* among the mound part 21 is prepared as electrodeposited metal phase 25, and the ultra abrasive grains 14 are not formed. In addition, the electrodeposited metal phase 25 does not need to be formed at the bottom of abrasive-grain-layer 22*a*, and in this case, the bottom of abrasive-grain-layer 22*a* is composed with the exposed surface of base metal 19. At the mound part 21, an abrasive grain layer 22 is the small abrasive-grain-layer parts 24 in which the ultra abrasive grains 14 and the electrodeposited metal phase 25 were formed along the surface of the almost columnar shape.

The manufacture method of the electrodeposited abrasive wheel 120 according to the embodiment is almost the same as that of the first embodiment. The manufacture method of an electrodeposited metal phase 25 is explained in FIG. 10. At the small abrasive-grain-layer part 24, each of the mound parts 21 on base metal 19 will be formed by side wall 21*c*, which was formed at all circumferences, and corner R part 21*a*, and top part 21*b*. The ultra abrasive grains 14 with the range of 11–500 pieces are adhered on whole surface by the electrodeposited metal phase 25.

At the periphery domain 126, ultra abrasive grains 14 are distributed and fixed separately on the ring-like convex plane part 127 with the electrodeposited metal phase 25. And these ultra abrasive grains 14 are in same height H as the small abrasive-grain-layer part 24. Furthermore, degree of concentration of ultra abrasive grains 14 at the periphery domain 126 is set higher than the degree of concentration of ultra abrasive grains 14 at the central domain 124.

And the electroplating of ultra abrasive grains 14 at the central domain 124 and the periphery domain 126 is explained with reference to FIG. 10. Masking is performed except for the convex plane part 127 and each mound part 21—. And priming electroplate of thin layer which consists of nickel (Cu, Cr, etc. are sufficient) all over the convex plane part 127 and each mound parts 21 is performed as priming electroplate layers 25*a* and 25*b*. Subsequently, plural ultra abrasive grains 14 are adhered on priming electroplate layer 25*a* and 25*b* with electroplating by the first electrodeposited metal phase 25*c* and 25*d* which consists of nickel (Cu, Cr, etc. are sufficient). Then a masking sheet is stripped from one-side 21*a,* electroplated again on the whole surface, and the second electrodeposited metal phase 25*e* and 25*f* are formed, for example from nickel (Cu, Cr, etc. are sufficient).

Or a masking sheet may be left as it was, then the second electrodeposited metal phase 25*e* and 25*f* may be formed only at the convex plane part 127 and the mound part 21. In this case, electrodeposited metal phase 25 is not formed at the bottom of abrasive-grain-layer 22*a* which makes a concave part.

Thus, the abrasive grain layer 122 to which the ultra abrasive grain 14 adhered at the mound parts 21 and the convex plane part 127 respectively, is formed by the electrodeposited metal phase 25 and shown in FIG. 10.

Where the electrodeposited metal phase 25 consist of priming electroplate layers 25*a* and 25*b,* and the first and second electrodeposited metal phases 25*c,* 25*d,* 25*e,* and 25*f.* Then the electrodeposited abrasive wheel 120 is formed.

In this case, the degree of concentration of the ultra abrasive grains 14 at periphery domain 126 can be set higher than that of the central domain 124 by arranging the interval of the small abrasive-grain-layer parts 24 suitably. As another process, electroplating may be carried out separately by masking one side of the convex plane part 127 in turns with mound part 21—. In this case, if increase-and-decrease adjustment of the amount of addition of the ultra abrasive grains 14 in electroplate liquid is carried out, the degree of concentration at the periphery domain 127 and the central domain 124 may be controlled as different value.

Moreover, abrasive grain layer 24 may be formed directly by electroplating, without preparing priming electroplate layer to the mound parts 21 and the convex plane part 127 on a base metal 19. Masking is removed independently, and electroplating may be performed to bottom part 22A, then the bottom of abrasive-grain-layer 22*a* may be formed.

In addition, the diameter of the electrodeposited abrasive wheel 120 is set, for example as 101 mm, and the width of the peripheral domain 126 is set, for example as about 3 mm or less. The area of the ultra abrasive grains 14 to the whole surface area of grinding-surface 20*a* is set within the range of 20%–80%, accounted by plane-projection of the electrodeposited abrasive wheel 120.

The electrodeposited abrasive wheel 120 according to the embodiment is equipped with the composition mentioned-above, and conditioning is performed like the form of the first embodiment.

And in the electrodeposited abrasive wheel 120 especially according to the embodiment, the degree of concentration of ultra abrasive grains 14 is higher at peripheral domain 126 on polishing-surface 20*a* than the central domain 124.

Therefore, the stability of the electrodeposited abrasive wheel 120 at the time of grinding becomes high, and electrodeposited abrasive wheel 120 seldom rocks and vibrates in the vertical direction, then plane balance is improved. Moreover, ground wastes etc. can be discharged outside from the concave groove 17 suitably prepared in the peripheral domain 126.

At the peripheral domain 126, since the height difference of ultra-abrasive grains 14 and the electrodeposited metal phase 25 is about ⅓ of the mean particle diameter of ultra-abrasive grain 14, and degree of concentration is high, whole surface contact is easy to occur at the time of grinding. However, if clogging are curried out at ultra-abrasive grains 14, the influence on sharpness is small and hardly make bad influence on the grinding performance at the central domain 124, because the width of the periphery domain 126 is set as about 3 mm or less.

According to the embodiment as mentioned above, the vibration at the time of grinding can be suppressed, because plane balance can be kept in good condition by the contact of peripheral domain 126 of electrodeposited abrasive wheel 120 to pad 4. Furthermore, at the central domain 124, only the ultra abrasive grains 14 of the small abrasive-grain-layer parts 24 contacts to pad 4, and the bottom of the abrasive-grain-layer 22*a* doesn't contact to pad 4 at the time of grinding. Therefore, the abutment pressure at ultra abrasive grains 14 is high, and rough grinding and finish grinding can be performed continuously, and sharpness is good. And grinding can be carried out finely, without crushing the opening of the foamed layer of pad 4.

Moreover, concerning the periphery domain 126, many small abrasive-grain-layer parts 24 may be formed at predetermined intervals like the central domain 124, and ultra abrasive grains 14 on the mound parts 21 may be adhered by the electrodeposited metal phase 25. In this case, if diameter D and height H of the small abrasive-grain-layer parts 24 are made the same as the central domain 124, and the interval of the small abrasive-grain-layer parts 24 is narrowed than the central domain 124, then the degree of concentration of an ultra abrasive grains 14 can be raised. Or the number of the ultra abrasive grains 14, which adhered to the small abrasive-grain-layer parts 24 at the peripheral domain 126, may be more than the small abrasive-grain-layer part 24 at the central domain 24.

If such composition is adopted, sharpness is good and clogging can be prevented certainly and the discharge performance of ground wastes will be improved even at the periphery domain 126.

Moreover, the arrangement of the small abrasive-grain-layer parts 24 at the central domain 124 may be properly adopted into the shape of concentric circle, and spiral etc., in stead of the shape of lattice or meshes.

In addition, abrasive tool with metal binder phase should be preferable, which may be made to hold ultra-abrasive grains by sintering without using electroplating as electrodeposited metal phase 25 etc.

Figure 11:
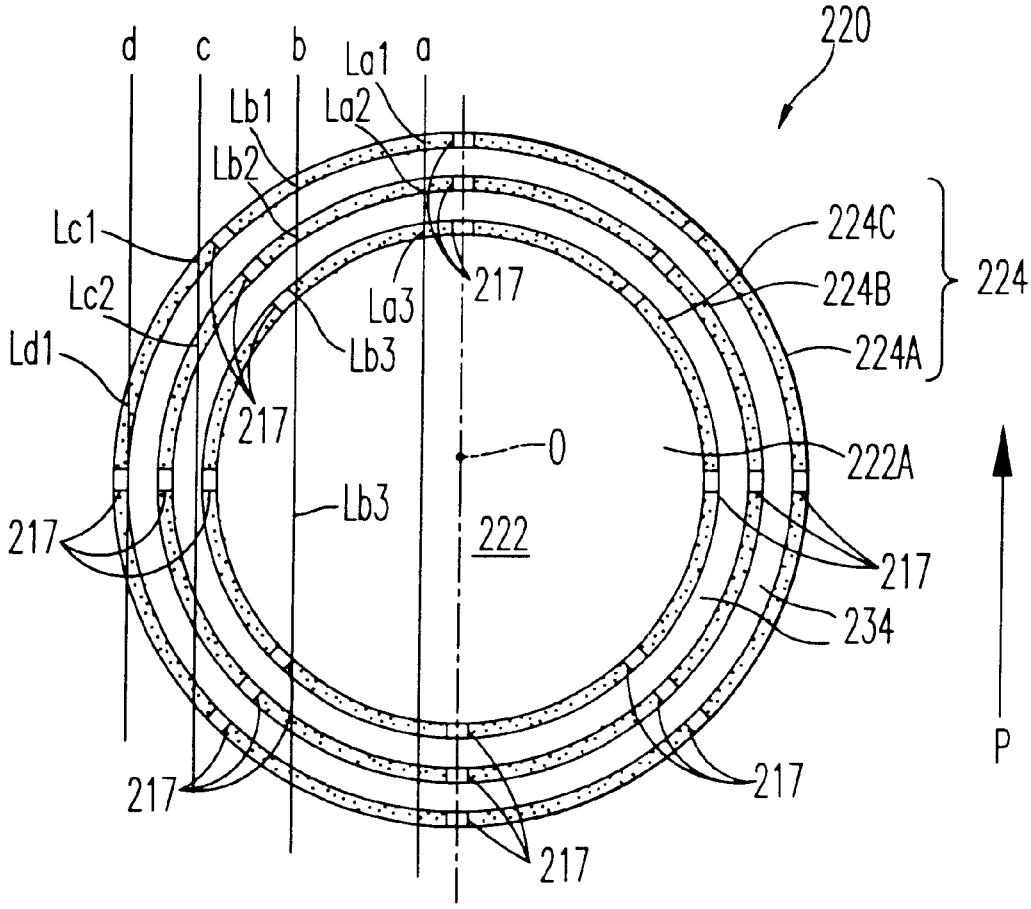
FIG. 11 is a plane view of the surface equipped with the abrasive grain layer of the wheel according to the fourth example of the present invention.
Figure 12:
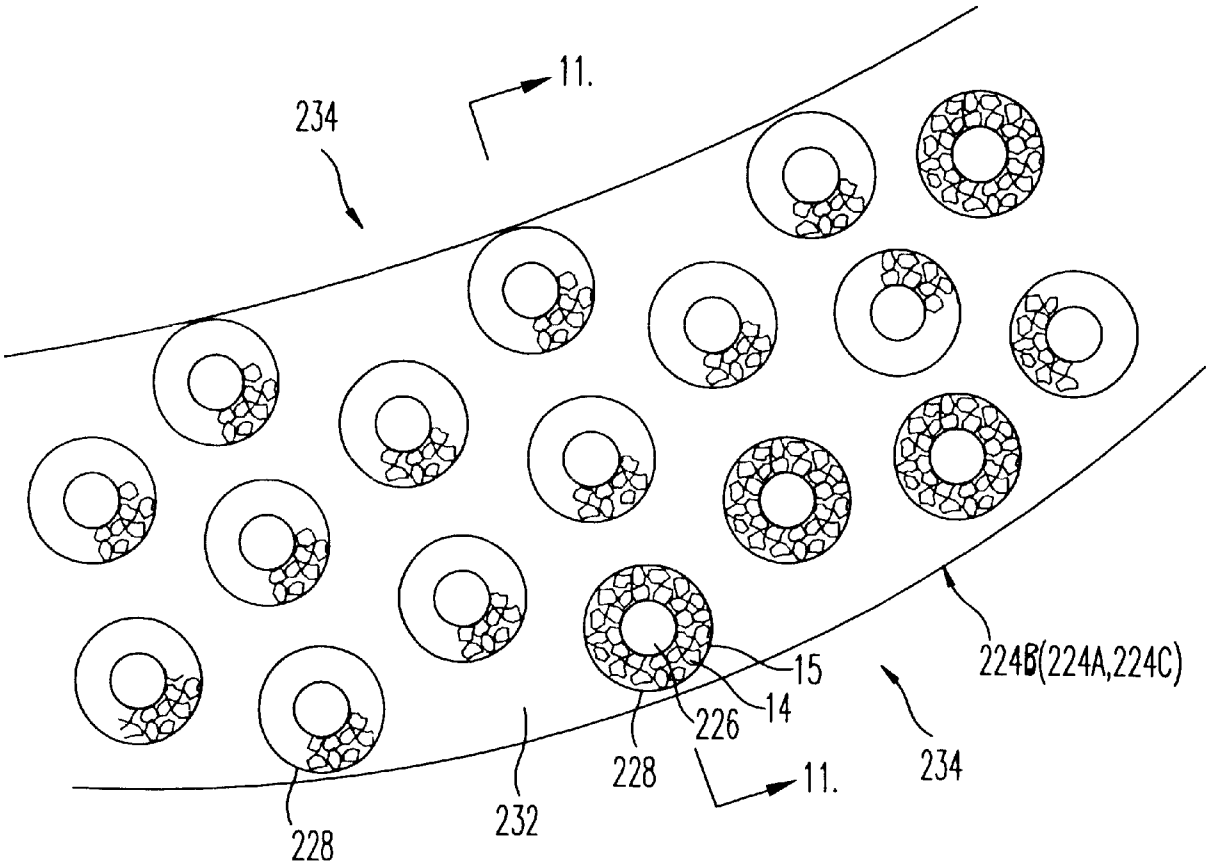
FIG. 12 is a partial enlargement of the second abrasive grain layer of the wheel shown in FIG. 11.
Figure 13:
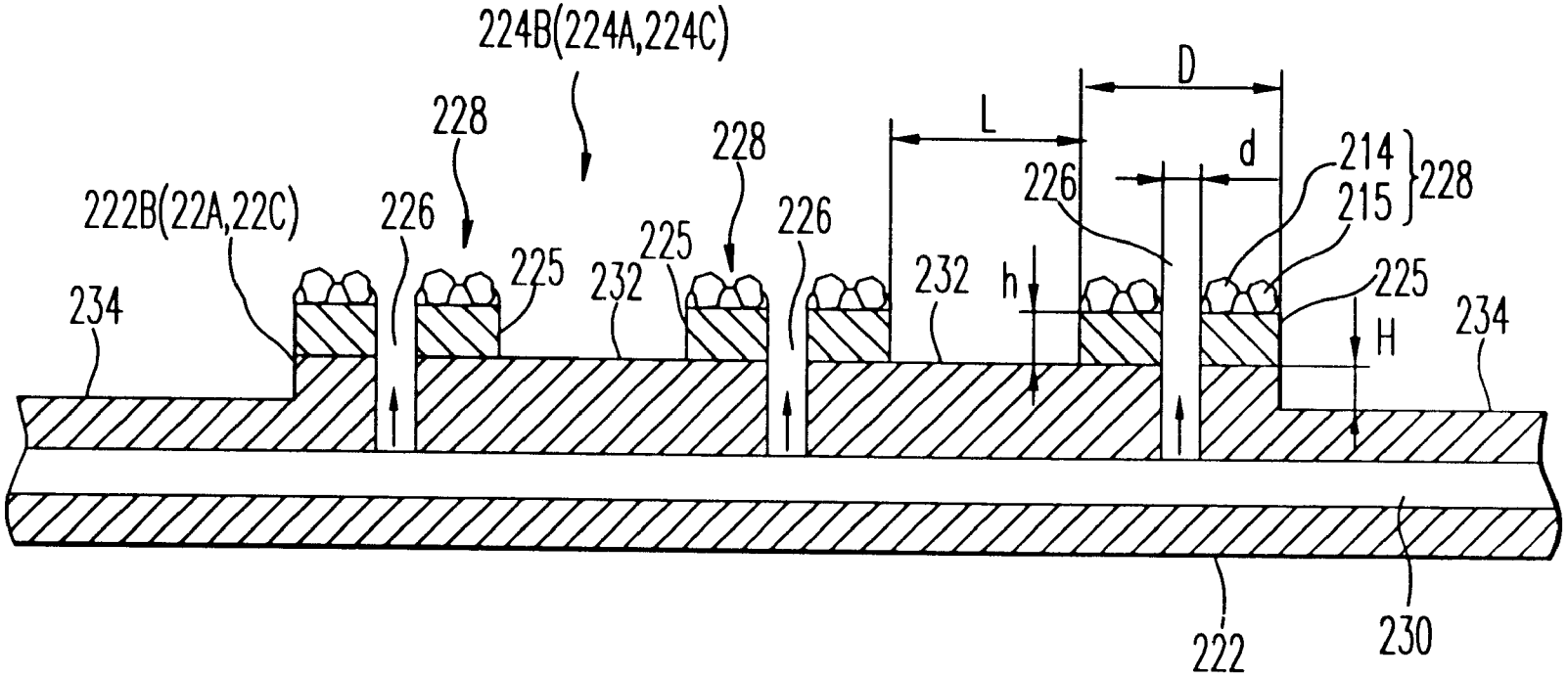
FIG. 13 is a sectional view at B—B line of the wheel shown in FIG. 12.

The wheel 220 (single layer abrasive tool) according to the fourth embodiment is shown in FIG. 11. As shown in FIGS. 12 and 13, the wheel is prepared and constituted of plural layers (three layers in figure) of abrasive grain layer 224, which is formed in the shape of ring with concentric circle (or may not be concentric circle), prepared at the perimeter side of one-side 222*a,* which is mostly round shaped on the disk shaped base metal 222. The first abrasive-grain-layer 224A is formed at outermost part with maximum diameter (for example, the same diameter as a base metal 222) on abrasive grain layer 224. At the inner side, the second abrasive-grain-layer 224B is formed at an interval, and the third abrasive-grain-layer 224C, which have minimum diameter at the innermost part, is formed at an interval.

The abrasive gram layer is not formed inside of the third abrasive-grain-layer 224C.

The ring shaped domain from the first to the third abrasive-grain-layer 224A, and B and C, at one-side 222*a* on base metal 222, is set higher than other domains in thickness. (for example, the difference of height H shown in FIG. 13) And indicated as first base metal part 222A, second base metal part 222B, and third base metal part 222C.

And on second base-metal part 222B shown in FIGS. 12 and 13, plural cylindrical mound parts 225 (protruded parts) are formed at intervals of predetermined, and the opening 226 of a cross-sectional round shape is formed at the center. And the mostly ring shaped small abrasive-grain-layer parts 228 are formed at the upper surface of the mound part 225. The ultra abrasive grains 214, such as diamond and CBN, are distributed and adhered on this small abrasive-grain-layer parts 228 by the metal binder phase (electrodeposited metal phase) 215 of nickel or nickel alloy. An ultra abrasive grains 214 constitute the single layer abrasive tool, which arranges only one layer in the thickness direction, and for example, this small abrasive-grain-layer part 228 is manufactured by electroplating.

In addition, many small abrasive-grain-layer parts 228 of the same composition are formed on the first base-metal part 222A and third base-metal part 222C. And as shown in FIG. 13, inside of the base metal 222, a water path 230 is formed covering the domains from the first to the third abrasive-grain-layer parts 224A, 224B, and 224C. This water path 230 pass through the openings 226 formed in the center of each small abrasive-grain-layer parts 228 prepared from the first to the third abrasive grain layer 224A, 224B, and 224C. Pure water is supplied as grinding liquid from the supply source, which is not illustrated, and circulated through the inside of the water path 230, then discharged outside from each opening 226.

Here, the inner diameter d of opening 226 is set as the range of 0.5–3 mm, and the diameter D of the mound part 225 (protruded part) is set within the range of 2*d*–10*d*. Moreover, the height h of the mound part 225 from each base-metal part 222A, and B and C is set as the range of 0.1–5 mm. Furthermore, the distance L of two adjacent mound parts 225 and 225 is set within ⅓–2 times as much as the diameter D of the mound part 225.

And the sub-discharge path 232 is constituted, for example, in the shape of meshes between the adjoining mound parts 225 and 225 at each base-metal part 222A, and B and C. An abrasive grain layer will not be formed at this sub-discharge path 232, and the grinding wastes or the solidification of slurry s etc. of pad 4 will be discharged with grinding liquid. Furthermore, the mostly ring shaped main discharge path 234 is formed in the crevice among the first to the third abrasive-grain-layer 224A, B, and C. The main discharge path 234, 234 is broader than the sub discharge path 232, and the depth is also deeply formed in the same distance as the level difference H of the base-metal parts 222A, 222B, and 222C.

Moreover, the concave groove 117 for discharging slurry s or grinding waste, etc. is formed in the diameter direction at the predetermined interval, for example, 45 degree interval, at the first to the third abrasive-grain-layer 224A, and B and C. This concave groove 117 is formed in one sequence in FIG. 11 so that a straight line may be made toward the first to the third abrasive-grain-layer 224A, and B and C. And the bottom is mostly set as the same depth position with the main discharge path 234.

In addition, the concave groove 117 does not necessarily formed in one sequence, it may be shifted and laid out towards diameter direction, in different position along circumferential direction at the first to the third abrasive-grain-layer 224A, and B and C. Moreover, more concave groove 117 may be formed at outside layer than at inside layer. Thus, if it is formed as such way, cooling efficiency and the discharge performance of grinding wastes are good among the first to the third abrasive-grain-layer 224A, B, and C.

The wheel 220 according to the embodiment is constituted as mentioned above, then the manufacture method of a wheel 220 is explained by FIG. 14.

Figure 14A:
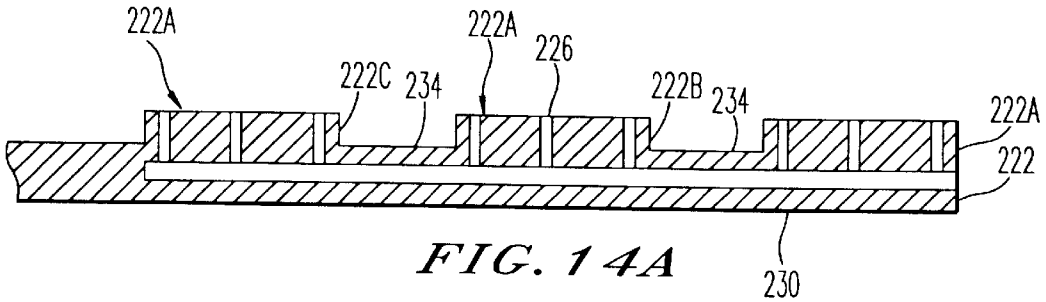
FIG. 14 shows the manufacturing process of the wheel according to the fourth example, as (A) of, (B), and (C).
Figure 14B:
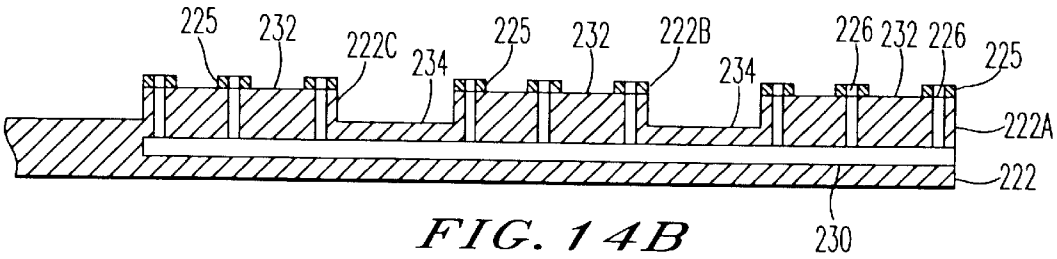

In FIG. 14(A), 222*a*, which is one-side of the disk shaped base metal 222 and consists of SUS304 etc. for example, is partially removed by etching etc., and the ring shaped upheaval of two or more layers are left, and referred to as first base-metal part 222A, second base-metal part 222B, and third base-metal part 222C. Within the portions removed by etching, the domain between each base-metal part 222A, and B and C makes the main discharge path 234. Thus, 222*a* is formed at one-side of a base metal 222.

In addition, one-side 222*a* may be formed by model fabrication etc. instead of etching. In addition, hollow water path 230 is formed inside of base metal 222 at the domain, which counters the first to the third base-metal part 222A, and B and C. This water path 230 passes through the openings 226 punched at intervals of predetermined at the first to the third base-metal part 222A, and B and C, respectively.

Subsequently, in FIG. 14(A), masking is performed except for the domain equivalent to the mound part 225, surrounding each openings 226 on the first-third base metal part 222A, B, and C, that pass through to a water path 230. Nickel or nickel alloy is electrodeposited in the mostly cylindrical shape so that the circumference of openings 226 may be covered. Many mound parts is formed at predetermined interval respectively, as shown 225—in FIG. 14(B). In addition, mound parts 225—may be formed by etching, electrical discharge machining, etc instead of electroplate.

Figure 14C:
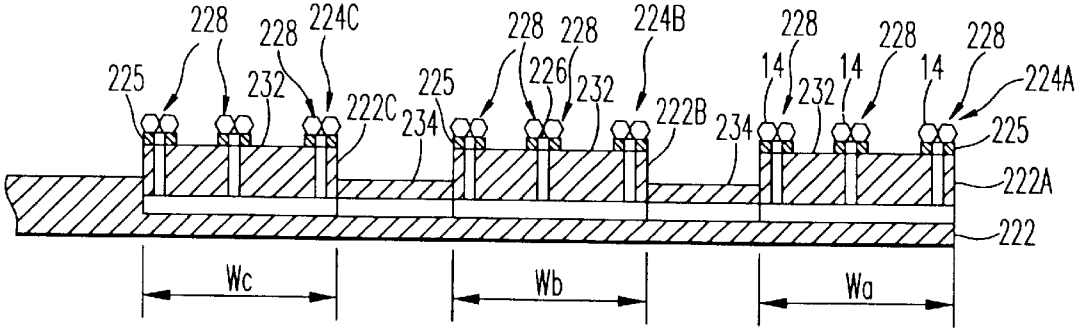

In addition, the domain except for the mound parts 225—constitutes sub-discharge path 232 on each base-metal part 222A, and B and C. Then before the electro-deposition of abrasive grain, in FIG. 14(B), the main and sub discharge path 234, 232 etc., except for the mound parts 225—, are masked by resin. Then electroplate is performed, discharging air from each openings 226 through water path 230. Thus as shown in FIG. 14(C), ultra abrasive grains 14 are adhered to the upper surface of each mound part 225 except for water path 230 by the metal binder phases 15, such as nickel.

In addition, the electroplate liquid which contains ultra abrasive grains 14 may be discharged from each openings 226 through water path 230, and electroplated on the mound parts 225. In this case, water path 230 is electrodeposited, but ultra abrasive grains 14 do not adhere.

By the way, at the first-third abrasive-grain-layer 224A, B and C, which are separated each other with the predetermined interval in the direction of diameter, the width Wa, Wb, and Wc are set as follows. That it has maximum value at innermost abrasive-grain-layer 224C and it is set up so that width may become narrower gradually toward outside layer. Therefore, it is set as Wa<Wb<Wc. In addition, each width of the first-third abrasive-grain-layer 224A, B and C are set into fixed width, respectively.

The reason is given as follows. In FIG. 11, When the virtual lines a, b, c, and d with a direction which crosses mostly rectangular toward rotation direction P of pad 4 at arbitrary positions, are inscribed to each abrasive-grain-layer 224A, and B and C. The grinding length (for example, the grinding length Ld1 of virtual line d) which intersects the outer abrasive grain layer with large diameter, becomes larger than the grinding length which intersects the inner abrasive grain layer with smaller diameter. Then the workload at the time of grinding (grinding length) becomes larger. Therefore, the width of inner abrasive grain layer is enlarged, as to make the grinding length (work load) of each abrasive grain layer more uniform.

For example at FIG. 11, the virtual line prolonged toward mostly parallel direction to rotation direction P of a pad 4, against first-third abrasive-grain-layer 224A, and B and C, are drawn as virtual lines a, b, c, and d at arbitrary positions, shifted toward mostly rectangular to this direction. For example, virtual line a and b shall intersect the first-third abrasive-grain-layer 224A, and B and C, virtual line c shall inscribe third abrasive-grain-layer 224C and intersect the first and second abrasive grain layer 224 A and B, and virtual line d shall inscribe and intersect first abrasive grain layer 224A. And the grinding length at the domain of the first-third abrasive-grain-layer 224A, and B and C which each virtual lines a, b, c, and d intersect is set up as follows.

The grinding length (area) of the first-third abrasive-grain-layer 224A, and B and C, which intersect to virtual line a, nearest to the center O of wheel 220, is indicated as La1, La2, and La3. The grinding length (area) of the first-third abrasive-grain-layer 224A, and B and C, which intersect to virtual line b, the second nearest to rotation center O, is indicated as Lb1, Lb2, and Lb3. The grinding length (area) of A and B of the first and second abrasive grain layer 224A,B, which intersect to virtual line c, the third nearest to rotation center O, is indicated as Lc1 and Lc2. And the grinding length (area) of first abrasive-grain-layer 224A, which intersect to virtual line d, outside and farthest from rotation center O, is indicated as Ld1.

The width Wa, Wb, and Wc of the first-third abrasive-grain-layer 224A, and B and C are determined so as to satisfy following relations.

$$2\times(La1+La2+La3)\approx 2\times(Lb1+Lb2+Lb3)\approx 2\times(Lc1+Lc2)\approx 2\times(Ld1)$$

Thus it is set to Wa<Wb<Wc.

The wheel 220 according to the embodiment is equipped with mentioned-above composition. In case of performing the conditioning of pad 4, a wheel 220 is rotated together with rotating pad 4, then the grinding of the nap raising of a pad 4 is carried out, and the flatness is recovered or maintained.

In case of grinding, at each small abrasive-grain-layer parts 228 of the first-third abrasive-grain-layer 224A, B and C on abrasive grain layer 224, grinding liquid, for example, pure water, are supplied, from the openings 226 formed in the center through the water path 230 to the grinding point on ultra abrasive grain 214 and pad 4. Thus, the adhesion and solidification of grinding wastes of pad 4 produced by grinding of ultra-abrasive-grains 214—of the small abrasive-grain-layer part 228, wiring metal of silicone wafer remained at pad 4, and grinding wastes of silicone etc., are suppressed among ultra-abrasive-grains 214. Then the viscosity of the grinding liquid containing these grinding wastes is reduced, and the discharge is promoted at the main discharge path 234 through the sub-discharge path 232. Furthermore, the cooling of ultra abrasive grains 214 is promoted by grinding liquid, the damage of ultra abrasive grains 214 is prevented, and the deposition accumulation of various grinding wastes among grain 214 and 214 is suppressed.

Therefore, grinding waste of a pad 4, other various grinding waste, etc. which were generated by ultra-abrasive-grains 214—at the small abrasive-grain-layer parts 228 on each abrasive-grain-layer 224A, and B and C are flushed with the grinding liquid discharged from openings 226. Then the wastes are discharged through the sub-discharge path 232, which is around the small abrasive-grain-layer part 228, without blocked among ultra-abrasive-grains 214—, and discharged outside through the main discharge path 234 and the guide groove 217.

Furthermore, the grinding point of ultra-abrasive-grain 214—on each small abrasive-grain-layer part 228 are prepared in size D, as to the grinding liquid supplied from the neighboring openings 226 spread enough, and grinding wastes don't accumulate among ultra abrasive grains 214—and flushed. Furthermore, level difference h between grinding point and the sub-discharge path 232 is set to discharge grinding liquid and grinding wastes easily.

Figure 15:
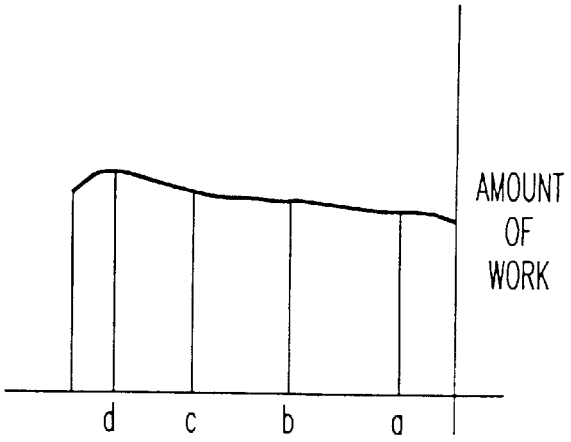
FIG. 15 is a figure showing the relation of the abrasive-grain-layer position and work load in the rotation direction of a pad, about the half-circled portion of the wheel shown in FIG. 11 indicated by dashed line.

Furthermore, on the first-third abrasive-grain-layer 224A, B, and C of abrasive grain layer 224, concerning to the virtual lines a, b, c, and d arranged at plural arbitrary positions shifted, toward the direction mostly rectangular to rotation direction P of pad 4, from center O of wheel 220, it is set as follows. The sum of the grinding length on each virtual line (sum of area), 2×(La1+La2+La3), 2×(Lb1+Lb2+Lb3), 2×(Lc1+Lc2), 2×(Ld1) become mutually almost the same. Then as shown in FIG. 15, grinding can be performed with almost uniform workload loaded at all the domains of rocking direction, which crosses mostly rectangular toward the direction P of abrasive grain layer 224. Therefore, rocking movement is not necessarily required at the conditioning of pad 4, if wheel 220 is set on pad 4 and rotated. And grinding machining of the pad 4 can be performed efficiently and with better flatness.

According to the embodiment mentioned above, various grinding wastes, such as grinding waste of a pad 4, solidification of slurry s, and wiring metal of silicon wafer, grinding waste of silicone, are flowed out easily from ultra-abrasive-grains 214—, that are grinding point of the small abrasive-grain-layer part 228, to sub-discharge path 232 with grinding liquid at adjoined openings 226. Then blocking can be certainly suppressed among ultra-abrasive-grains 214—. Furthermore with this grinding liquid, worn out or abrasion of ultra abrasive grains 214, can be suppressed toward various grinding wastes, cooling of an ultra abrasive grains 214 can be promoted, and damage of an ultra abrasive grains 214 can be suppressed. Furthermore at the abrasive grain layer 224 in direction mostly parallel to rotation direction P of pad 4, the sum of each grinding length (sum of area) is almost equal, then grind machining with improved flatness can be obtained.

Subsequently, the fifth embodiment of the present invention are explained by FIG. 16.

Figure 16:
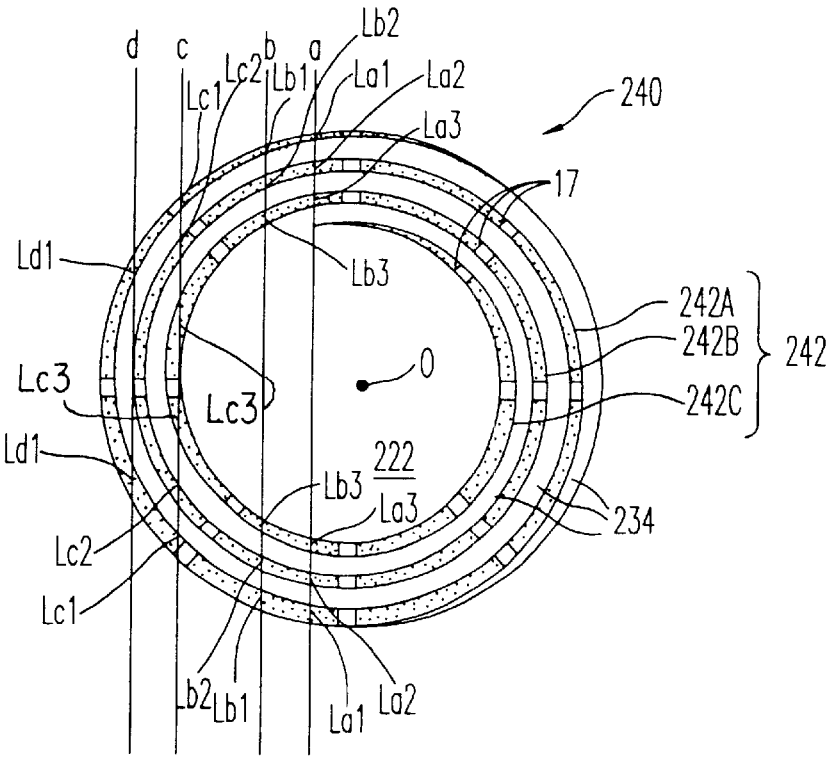
FIG. 16 is a plane view of the wheel according to the fifth example of the present invention.

The basic composition of the wheel 240 shown in FIG. 16 is the same as the wheel 220 according to the first embodiment. And the difference, is that the abrasive grain layer 242 forms the continuous shape of spiral of one layer. It is preferable that abrasive grain layer 242 are formed wound around at least three layers in the direction of diameter at an interval (formed in three layers in FIG. 16).

Also on this embodiment, abrasive grain layer 242 could be seen as three layers formed from outside to inside in the direction of diameter, and regarded as follows. That it is spirally and continuously formed one by one as the first abrasive grain layer of the outermost circumference 242A, the second abrasive grain layer 242B, and innermost third abrasive-grain-layer 242C. And the spiral main discharge path 234 is formed among each abrasive grain layers 242A, 242B, and 242C. Many small abrasive-grain-layer parts 228—are prepared at each abrasive grain layers 242A, 242B, and 242C at predetermined interval L, and sub-discharge path 232 is formed in the crevice.

The same action and effect as the fourth embodiment is achieved at this embodiment.

Hereafter, the sixth embodiment of the present invention is explained.

Figure 17:
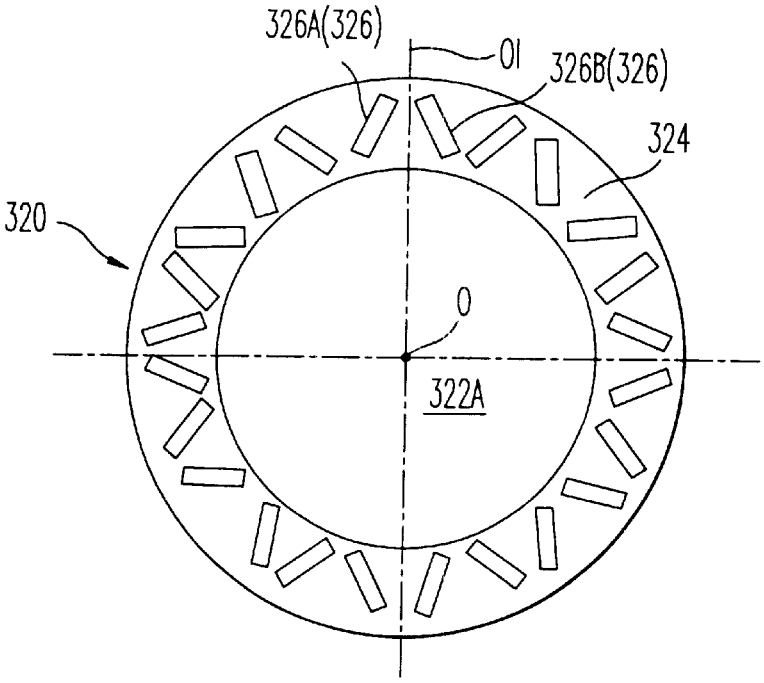
FIG. 17 is a plane view of the wheel according to the sixth example.
Figure 18:
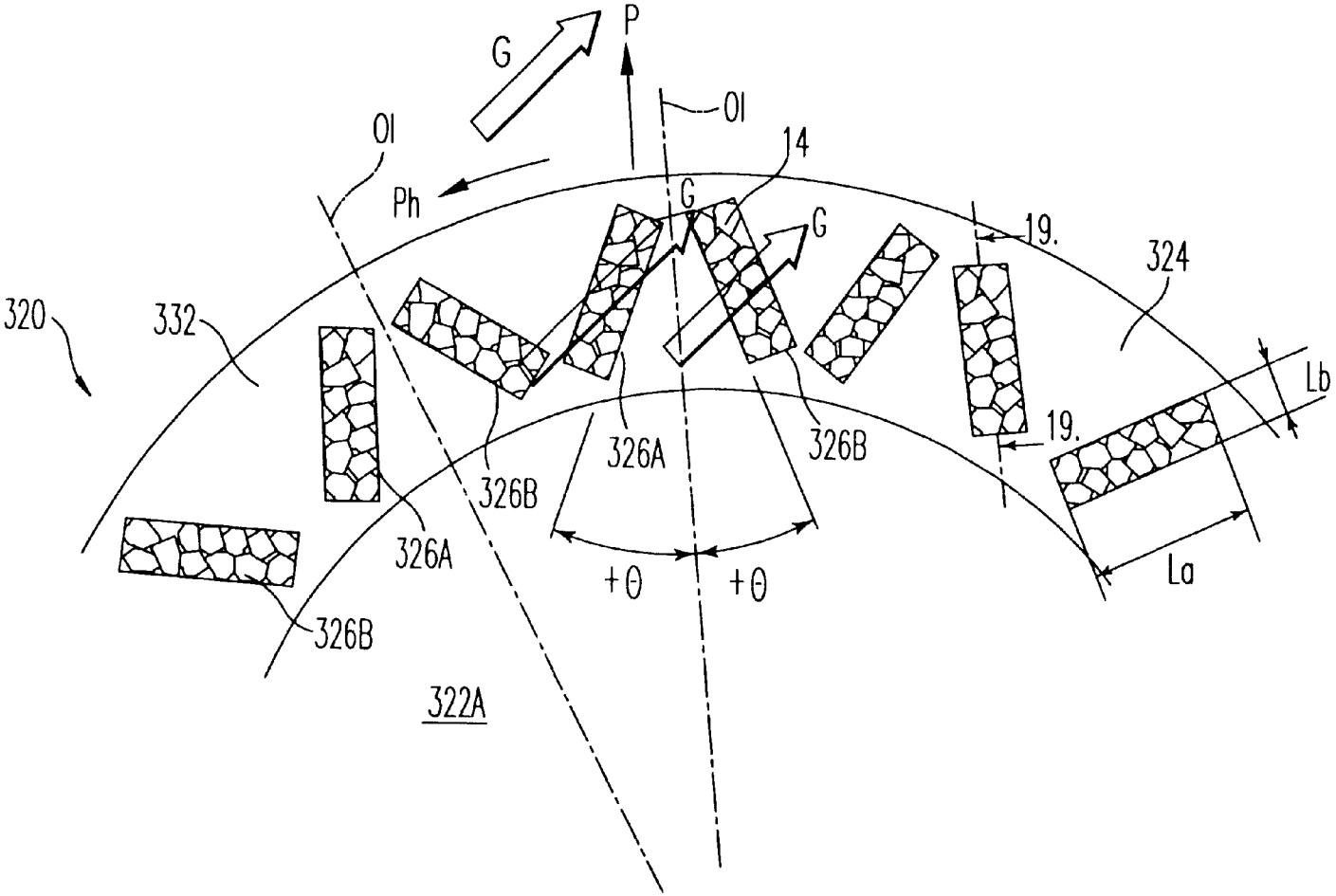
FIG. 18 is a partial enlargement of the abrasive grain layer of the wheel shown in FIG. 17.

The wheel 320 (single layer abrasive tool) according to the embodiment shown in FIGS. 17 and 18, and is constituted preparing abrasive grain layer 324, which is mostly ring shaped at the perimeter of one-side 322*a* of mostly round shaped on disk shaped base metal 322. An abrasive grain layer 324 is constituted with plural small abrasive-grain-layer parts 326, that are shaped mostly rectangle or stick by plane projection, and arranged along circumferential direction with their longitudinal direction toward approximately at the center O of base metal 322. In addition, sub-discharge path 332 is constituted at the domain among small abrasive-grain-layer parts 326, that are arranged along the circumferential direction mutually dissociated on abrasive grain layer 324.

Figure 19:
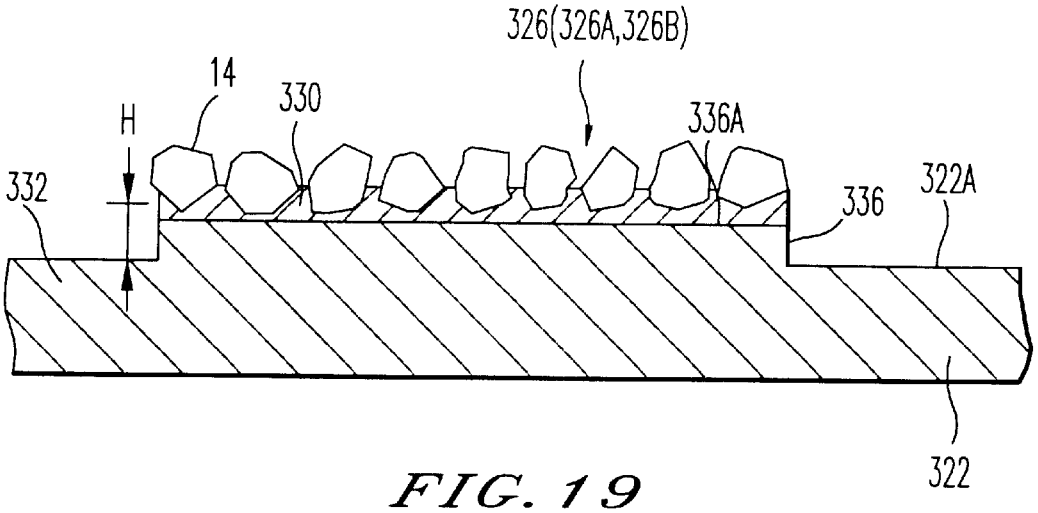
FIG. 19 is a sectional view at C—C line showing other form of the small abrasive-grain-layer parts.

As shown in the longitudinal section of FIG. 19, each small abrasive-grain-layer parts 326 are formed as follows. That the mound parts 336 upheaved in mostly rectangular parallelepiped form are formed from on one-side 322*a* of a base metal 322. And ultra-abrasive-grains 14—are formed on the upper surface 336*a* of this mound part 336 adhered by metal binder phase 330. The number of the ultra abrasive grains 14 per small abrasive-grain-layer part 326 is made into 3–250 pieces.

The height H of the mound part 336 from one-side 322*a* of base metal 322 is set in the range of 0.1–5.0 mm. Then, grinding liquid and grinding wastes are not blocked between grinding point and sub-discharge path 332, and passed smoothly and discharged. Moreover, abrasive grain layer 324 doesn't contact at whole surface even if the pad 4 is a elastic grinding work piece, and an abutment pressure can be maintained high because pad 4 can be made to contact only at the grinding point of ultra abrasive grains 14. If height H of the mound part 336 is less than 0.1 mm, there will be no effect mentioned-above and it will be easy to carry out whole surface contact. If it exceeds 5.0 mm the improvement of the effect beyond will not be obtained, and it is not economical to form the higher mound part, which exceeds 5.0 mm.

Moreover, when the size of the small abrasive-grain-layer part 326, mostly rectangular shaped in the plane projection are represented as the length La×Lb width, Lb is made into about 1.3 to 10 times of the mean particle diameter of ultra abrasive grains, and length La is made into size of 3 times or more of width Lb so as to set up large aspect ratio. Length La is set as 2–15 mm, for example La=10 mm and Lb=2 mm.

In FIGS. 17 and 18, the small abrasive-grain-layer part 326 is composed as follows. For example, small abrasive-grain-layer part 326, which is at front side of the rotation direction of a wheel 320 toward central line O1, is represented as first small abrasive-grain-layer part 326A and prepared inclined by acute positive angle θ of a central line O1. And small abrasive-grain-layer part 326 at back side of the rotation direction is represented as second small abrasive-grain-layer part 326B, and prepared with negative angle −θ. And a pair of small abrasive-grain-layer parts 326,326 is arranged in the direction of a circumference, and in the shape of character /\. These first small abrasive-grain-layer part 326A and second small abrasive-grain-layer part 326B are mostly in symmetry on both sides of the central line O1 of the direction of diameter which passes through center O.

And, for example in FIG. 18, if wheel 320 rotates toward Ph direction against the movement direction P of the pad 4, which is grinding work piece, then grinding direction G at the abrasive grain layer 324 is determined by combination of the force of both directions P and Ph.

This grinding direction G changes its angle with direction Ph according to the circumferential rotation position of abrasive grain layer 324.

The wheel 320 according to the embodiment is equipped with composition mentioned-above. In case of performing the conditioning of pad 4, wheel 320 is rotated in the Ph direction along with pad 4 rotated in the direction of P, then the grinding of the nap raising of pad 4 is carried out, and flatness is recovered or maintained. In case of grinding, since plural small abrasive-grain-layer parts 326A and 326B with large aspect ratio are arranged mostly in the shape of character /\ and laid out along circumferential direction on the ring-like abrasive grain layer 324. Therefore, mostly line contact will be carried out at all circumference. Then, even in the case that there is some unevenness on the surface of abrasive grain layer, stability is improved and vibration is seldom produced at the time of grinding, compared with the conventional wheel with ring-like abrasive grain layer which contact on its surface. Therefore, abutment pressure can be maintained high and partial damage is not given to a pad 4.

Moreover, in FIG. 18, at each pair of small abrasive-grain-layer parts 326A and 326B, that are formed mostly in the shape of character of /\ in a certain domain of abrasive grain layer 324, science first small abrasive-grain-layer part 326A make an inclination angle θ nearer to grinding direction G against central line O1, the grinding length of pad 4 becomes long, and grinding is performed for a long time. Therefore, the amount of grinding is large and grinding wastes generated is much, then clogging will be easy to happen.

Since second small abrasive-grain-layer part 326B, located at back side toward the rotation direction of this first small abrasive-grain-layer part 326A, crosses with almost right angle against grinding direction G, then the grinding length of pad 4 is short. Therefore, the grinding wastes, that are produced at first small abrasive-grain-layer part 326A then cause clogging between both small abrasive-grain-layer part 326A and 326B etc., can be moved to the behind of small abrasive-grain-layer part 326B together with grinding liquid etc., then they can be discharged to the exterior of a wheel 320, and clogging can be canceled.

Moreover, since the abrasive grain layer 324 of wheel 320 is in the shape of ring, the rotation direction Ph may be located in the same direction as rotation direction P of pad 4 or in the opposite direction, depending on its rotation position. In this case, grinding direction G will overlap in the direction P or and the direction Ph. Even in this case, pairs of the first and second small abrasive-grain-layer parts 326A and 326B incline in the opposite side mutually against central line O1 respectively. Therefore, in most case, grinding direction G will cross aslant against small abrasive-grain-layer part 326. As mentioned above, long grinding can be performed at one of the small abrasive-grain-layer part 326, and short grinding can be carried out at another small abrasive-grain-layer part 326, then grinding wastes can be discharged backward toward rotation direction Ph, and clogging can be canceled.

As mentioned above, at wheel 320 according to this embodiment, plural small abrasive-grain-layer parts 326, mutually arranged separately, are inclined toward central line O and longitudinally laid out mostly in the direction of diameter. Thus, since plural small abrasive-grain-layer parts 326—make mostly line contact to pad 4, the area of contact and contact pressure with pad 4 are stabilized. Even if there was unevenness at the surface of the small abrasive-grain-layer part 326, stability of grinding tool is good and minute vibration at the time of grinding can suppressed, then the fall of grinding performance is suppressed and the partial damage to pad 4 can be prevented.

Moreover, by means of plural pairs of small abrasive-grain-layer parts 326A and 326B—, which are arranged inclined at an opposite side mutually against central line O1, the amount of grinding can be secured by turns, the clogging of grinding wastes can be canceled, the discharge performance of grinding waste can be improved, and fall of sharpness can be suppressed. Subsequently, the seventh embodiment of the present invention is explained by FIG. 20.

Figure 20:
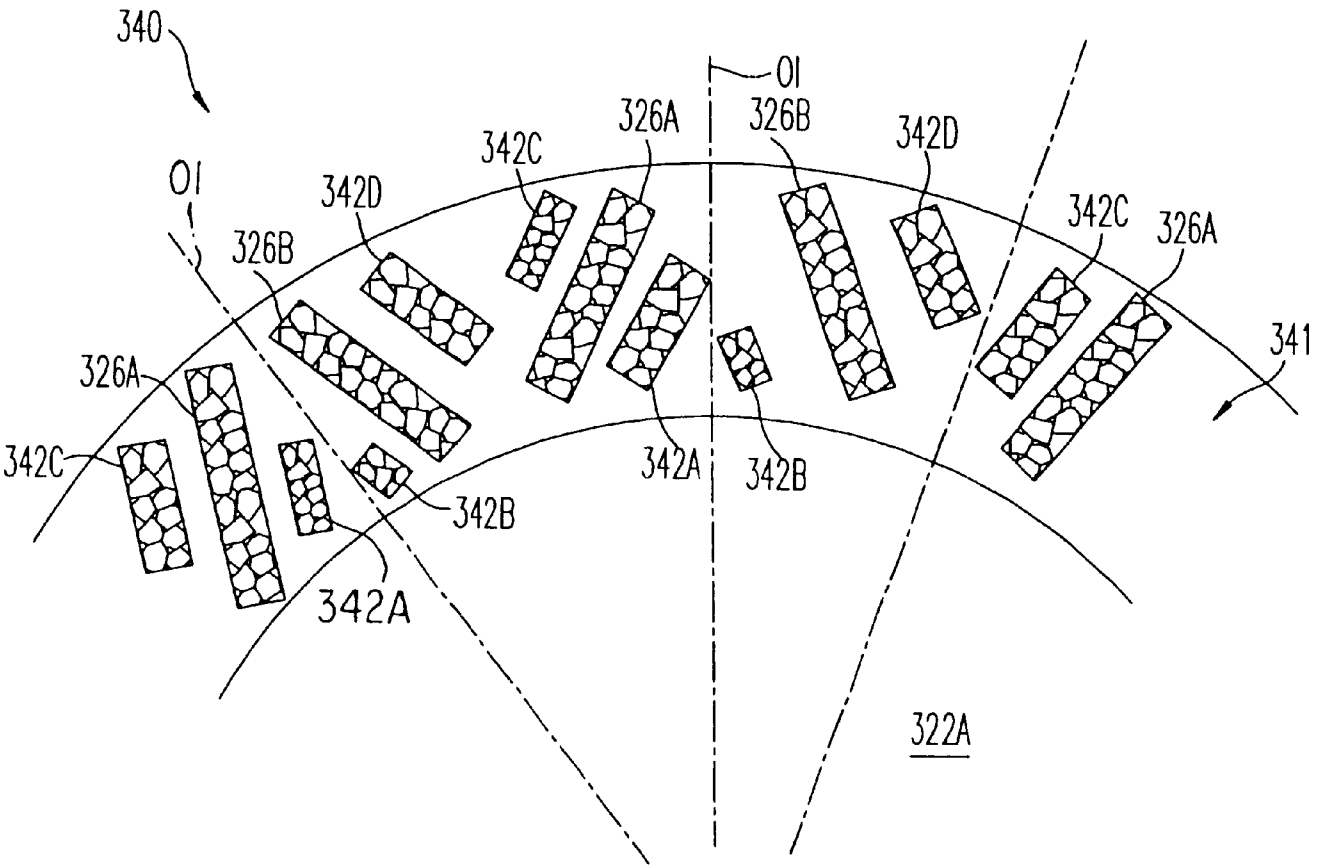
FIG. 20 is a partial enlargement of the abrasive grain layer of the wheel according to the seventh example of this invention.

At the wheel 340 shown in FIG. 20, the first and second small abrasive-grain-layer parts 326A and 326B are arranged one by one at the circumferential direction in the shape of character mostly like /\, that are the same form as the small abrasive-grain-layer parts 326 by the sixth embodiment and prepared at the mound part 336 on outer abrasive grain layer 341 on one-side 322*a* of base metal 322. And third small abrasive-grain-layer part 342A and fourth small abrasive-grain-layer part 342B, with an aspect ratio smaller than the small abrasive-grain-layer part 326, are prepared between pairs os the first and second small abrasive-grain-layer parts 326A and 326B. And the third and fourth small abrasive-grain-layer parts 342A and 342B are arranged dissociated from other small abrasive-grain-layer parts respectively.

The third small abrasive-grain-layer parts 342A have aspect ratio with width Lb and length Lc(<La).

And formed longitudinally laid out mostly in parallel to the first small abrasive-grain-layer part 326A. Fourth small abrasive-grain-layer parts 342B have the aspect ratio with width Lb and length Ld(<La). And formed longitudinally laid out mostly in parallel to the second small abrasive-grain-layer part 326B. Moreover, the fifth small abrasive-grain-layer part 342C and sixth small abrasive-grain-layer part 342D are prepared respectively, with small aspect ratio and with the same width Lb as the small abrasive-grain-layer part 326, at the opposite side toward circumferential direction from third and fourth small abrasive-grain-layer parts 342A and 342B against the first and second small abrasive-grain-layer parts 326A and 326B. The fifth and sixth small abrasive-grain-layer parts 342C and 342D are arranged dissociated from other small abrasive-grain-layer parts 326A, 326B, 342A, and 342B, respectively. These small abrasive-grain-layer parts 342A, 342B, 342C, and 342D are also formed on the mound part.

The wheel 340 according to the seventh embodiment is equipped with composition mentioned-above. Since the third-sixth small abrasive-grain-layer part 342A-342D are distributed suitably between the first and second small abrasive-grain-layer parts 326A and 326B and arranged almost in parallel with either of the small abrasive-grain-layer parts 326A and 326B. Plural small abrasive-grain-layer parts 326A, 342A, and 342C with large grinding length at the time of grind machining of pad 4, and plural small abrasive-grain-layer parts 326B, 342B, and 342D, which are easy to discharge grinding waste, will continue by turns in circumferential direction. Then grinding efficiency will be improved much more upwards and the clogging by grinding waste can be canceled suitably.

Furthermore, the stability at polishing surface of wheel 340 is improved much more because the small abrasive-grain-layer parts 342A–342D are increased. Subsequently, the eighth embodiment of the present invention is explained in FIG. 21.

Figure 21:
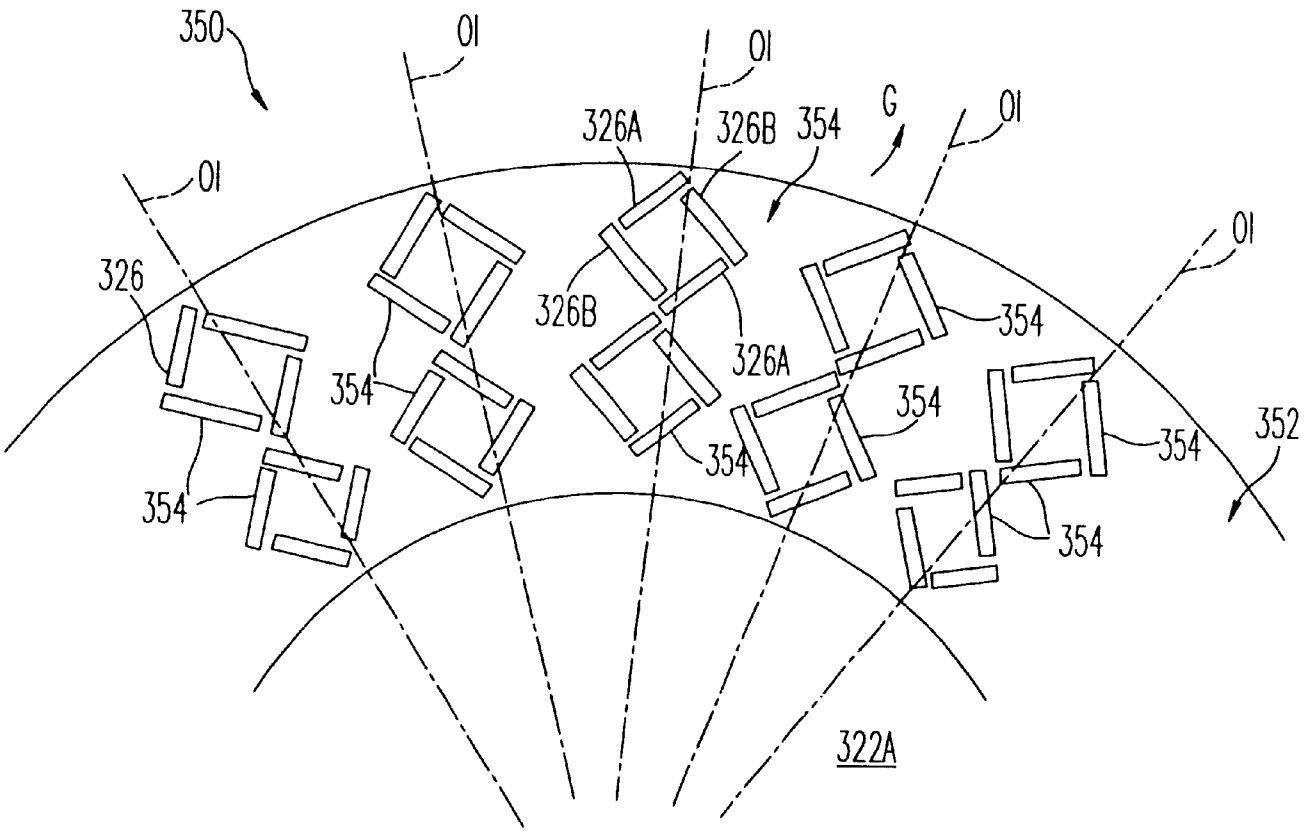
FIG. 21 is a partial enlargement of the abrasive grain layer of the wheel according to the eighth example.

At the wheel 350 shown in FIG. 21, mostly ring-like abrasive grain layer 352 is formed at the perimeter side of one-side 322*a* of disk shaped base metal 322. This abrasive grain layer 352 constructs with each two pairs of the first small abrasive-grain-layer part 326A, 326A and the second small abrasive-grain-layer part 326B, 326B into rhombus (or the shape of mostly parallel crosses), and constitutes rhombus formed part 354.

Every 2 sets of this rhombus formed part 354 are formed in the direction of a diameter, for example, and it is arranged one by one in the circumferential direction. Therefore, 2 sets of rhombus formed parts 354,354 located in a line in the direction of diameter, are formed to overlap with the diagonal line which mostly bisections each rhombus formed part 352 by a central line O1.

And in each rhombus formed part 354, the first two small abrasive-grain-layer part 326A, 326A and the second small abrasive-grain-layer part 326B, 326B are arranged each other to counter mutually. And each small abrasive-grain-layer parts 326A and 326B are laid out dissociated mutually.

According to such composition, at each rhombus formed part 354, the first small abrasive-grain-layer part 326A with large grinding length, which makes the angle approximately toward the grinding direction G in the diameter direction of wheel 350, and second small abrasive-grain-layer part 326B with short grinding length, which makes mostly rectangular cross to grinding direction G, are arranged by turns. And also, the first small abrasive-grain-layer part 326A and second small abrasive-grain-layer part 326B are arranged by turns in the circumferential direction.

Therefore, the effect appears that the amount of grinding can be greatly secured and the clogging of grinding wastes can be discharged effectively at each time. Furthermore, since the number of small abrasive-grain-layer parts, 326 is increased, the stability also improved at the time of grinding.

Figure 22:
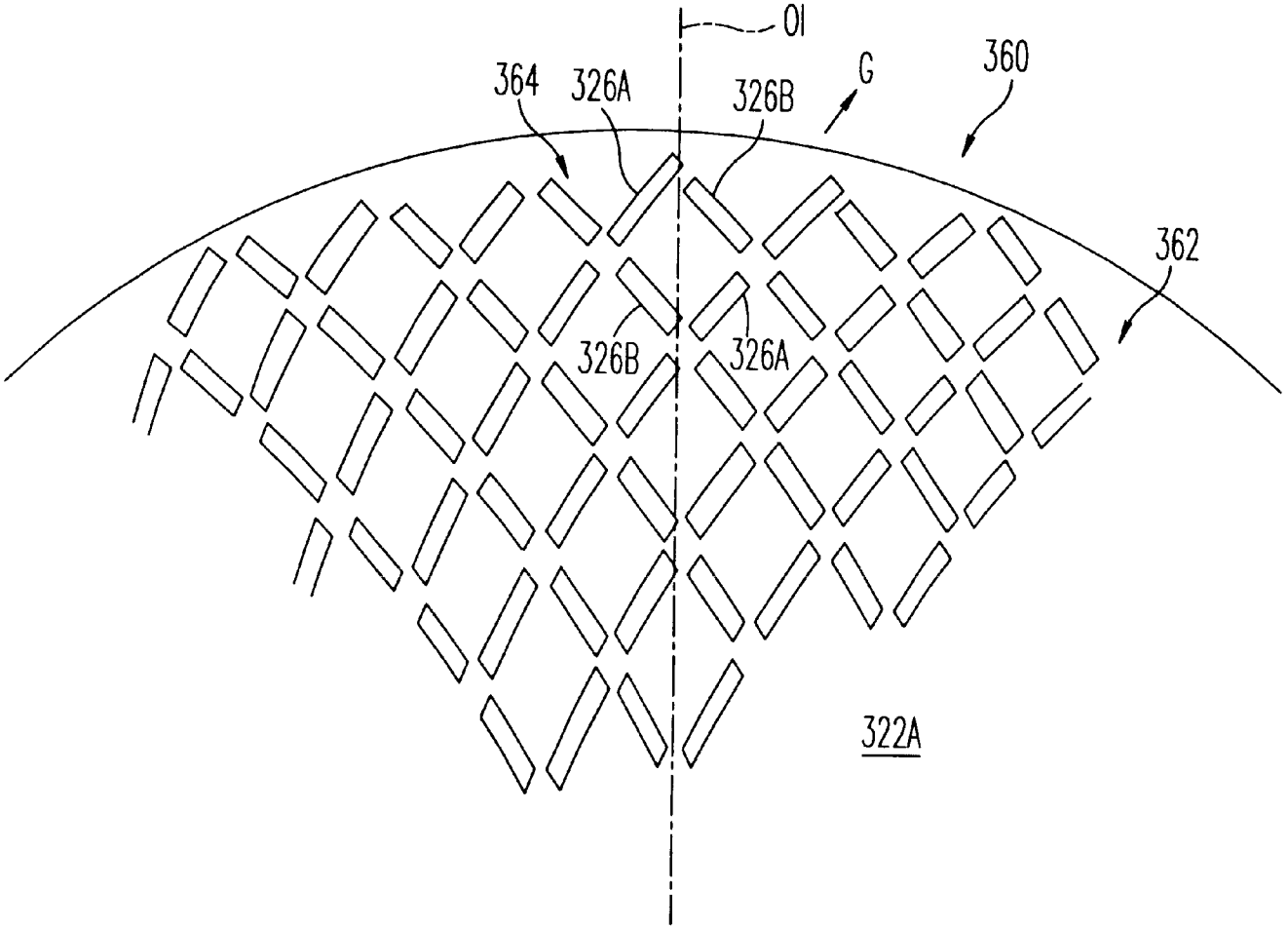
FIG. 22 is a partial enlargement of the abrasive grain layer of the wheel according to the ninth example.

In the wheel 360 shown in FIG. 22, at the abrasive grain layer 362 on one-side 322*a* of base metal 322, 2 pairs of first small abrasive-grain-layer part 326A and second small abrasive-grain-layer part 326B are arranged to rhombus (or mostly the shape of parallel crosses), and constitutes the rhombus formed part 364.

Furthermore, using first small abrasive-grain-layer part 326A or second small abrasive-grain-layer part 326B which constitutes each element, as common element, many rhombus formed part 364—are arranged in the shape of meshes. And in each rhombus formed part 364, the first two small abrasive-grain-layer part 326A, 326A and the second small abrasive-grain-layer part 326B, 326B are arranged each other to counter mutually. And each small abrasive-grain-layer parts 326A and 326B are laid out dissociated mutually. According to the present embodiment, since plural rhombus formed-part 364—is arranged on the whole surface of one-side 322*a*, at the time of grinding, the first small abrasive-grain-layer part 326A or second small abrasive-grain-layer part 326B with large grinding length, which has the angle approximately near to grinding direction G, and second small abrasive-grain-layer part 326B or first small abrasive-grain-layer part 326A with short grinding length, which mostly make rectangular cross to grinding direction G, are arranged by turns. The effect appears that the amount of grinding can be greatly secured and that the clogging of grinding wastes can be discharged effectively at each time. Furthermore, stability at the time of grinding will be improved much more because the number of the small abrasive-grain-layer part 326 is increased.

Subsequently, the embodiment of the tenth of the present invention is explained in FIG. 23.

Figure 23:
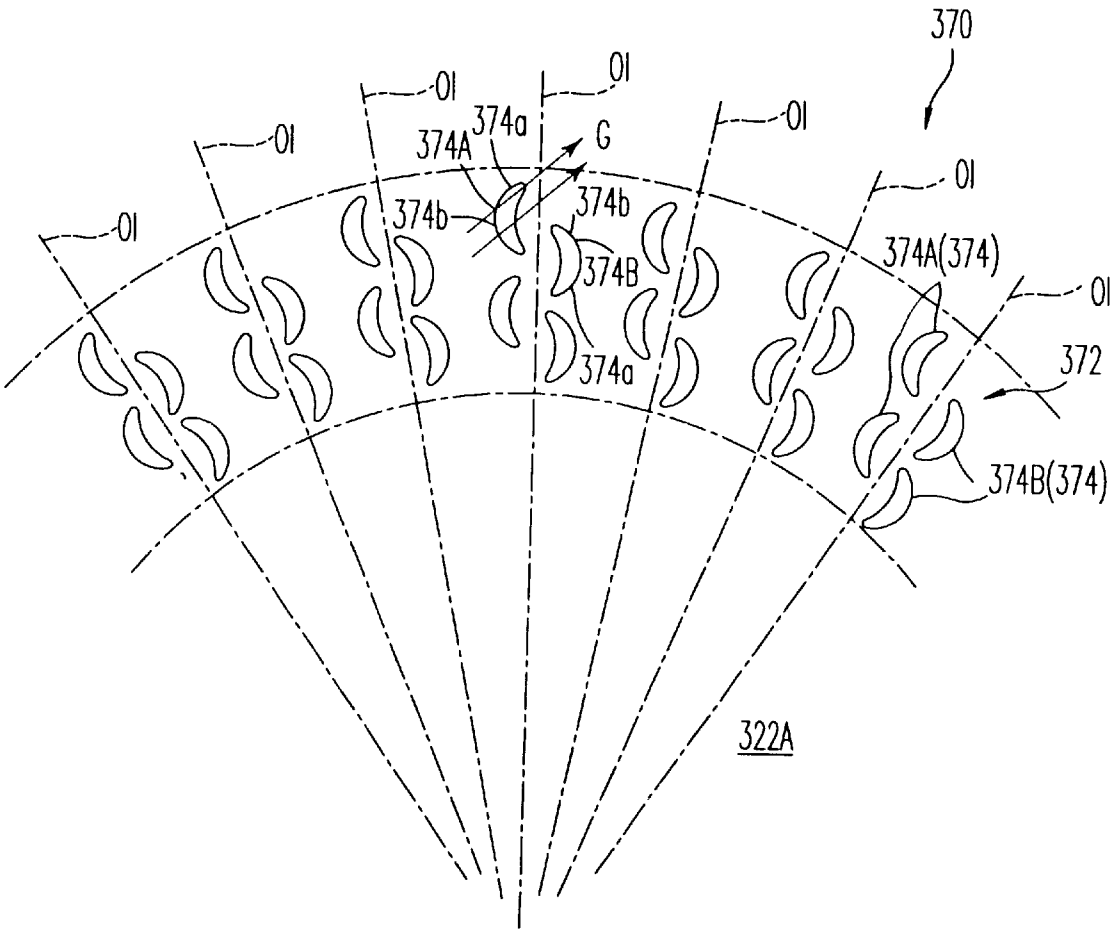
FIG. 23 is a partial enlargement of the abrasive grain layer of the wheel according to the tenth example.

In the wheel 370 shown in FIG. 23, the mostly ring-like abrasive grain layer 372 is formed in the perimeter side on one-side 322*a* of base metal 322.

At this abrasive grain layer 372—, plural mostly circular (the shape of a curve) small abrasive-grain-layer parts 374—are laid out toward the longitudinally direction of central line O1 with ½ length of the small abrasive-grain-layer part 374 shifted its position one by one, at the both side of central line O1—pulled at predetermined intervals. One of the small abrasive-grain-layer parts 374 countered on both sides of these central lines O1 and shifted one by one, is referred as the third small abrasive-grain-layer part 374A, and another is referred as fourth small abrasive-grain-layer part 374B.

Therefore, by the plane projection of wheel 370 at its perimeter side, for example, third mostly circle-like small abrasive-grain-layer part 374A is laid out so that central point of the circle may be located in the left-hand side of a central line O1 toward the central line O1 direction. And fourth small abrasive-grain-layer part 374B at the right-hand side of a central line O1 is laid out, shifted mostly ½ length of third small abrasive-grain-layer part 374A from the symmetry position of third small abrasive-grain-layer part 374A toward center point O. And the third and fourth small abrasive-grain-layer parts 374A and 374B shifted mostly ½ length and countered on both sides of a central line, are arranged in two pairs for each central line O1 at circumferential direction, and constitutes the abrasive grain layer 372.

Each small abrasive-grain-layer parts 374A and 374B are separated mutually and respectively, and the both ends of each small abrasive-grain-layer parts 374A and 374B are at the mostly equal distance from a central line O1. Furthermore, since the small abrasive-grain-layer part 374—is mostly circular, 374*a* which is one half of small abrasive-grain-layer part 374A in FIG. 23 makes the inclined angle nearer to the grinding direction G, therefore grinding length is large. The another half of 374*b* crosses mostly rectangular toward grinding-direction G then clogging can be canceled. Moreover, in fourth small abrasive-grain-layer part 374B, one half of 374*a* and other half of 374*b* are conversely arranged against small abrasive-grain-layer part 374A in the direction of length.

Therefore, there appears the effect that the amount of grinding can be secured greatly, the clogging of grinding wastes can be canceled effectively at each time, and the stability at the time of grinding is good.

In addition, the curve-like small abrasive-grain-layer parts 374 don't necessarily need to be arranged mostly circle-like shaped parts oppositely, they may be arranged in one direction. Moreover, third small abrasive-grain-layer part 374A and the fourth small abrasive-grain-layer part 374B may be arranged oppositely without shifting toward the central line O1 direction.

Moreover, as for other example of the mostly curve-like small abrasive-grain-layer part 374, it may be constituted and arranged mutually as S character-like form in the direction of diameter or in the circumferential direction.

The proper small abrasive-grain-layer parts mentioned above, for example, the abrasive grain layer 324 etc. which are the combination of the first and second small abrasive-grain-layer parts 326A and 326B may be formed in plural ring shape such like three layers etc. in FIG. 11, or in spiral like as shown in FIG. 16.

The wheel 420 (single layer abrasive tool) according to the eleventh enforcement is constituted as follows. For example, shown in FIG. 24 to FIG. 26, the abrasive grain layer 424 which consists of two or more layers (a figure three layers) which make the shape of ring of concentric circle (it may not be a concentric circle) at the perimeter side of one-side 422*a,* which is mostly round shaped on the disk shaped base metal 422, is formed. As for an abrasive grain layer 424, first abrasive-grain-layer 424A with the maximum diameter (for example, the same diameter as a base metal 422) is formed at outermost perimeter side. At the inner side, second abrasive-grain-layer 424B is formed at an interval, and third abrasive-grain-layer 424C with the minimum diameter at innermost side is formed at an interval. The abrasive grain layer is not formed inside of third abrasive-grain-layer 424C.

Figure 25:
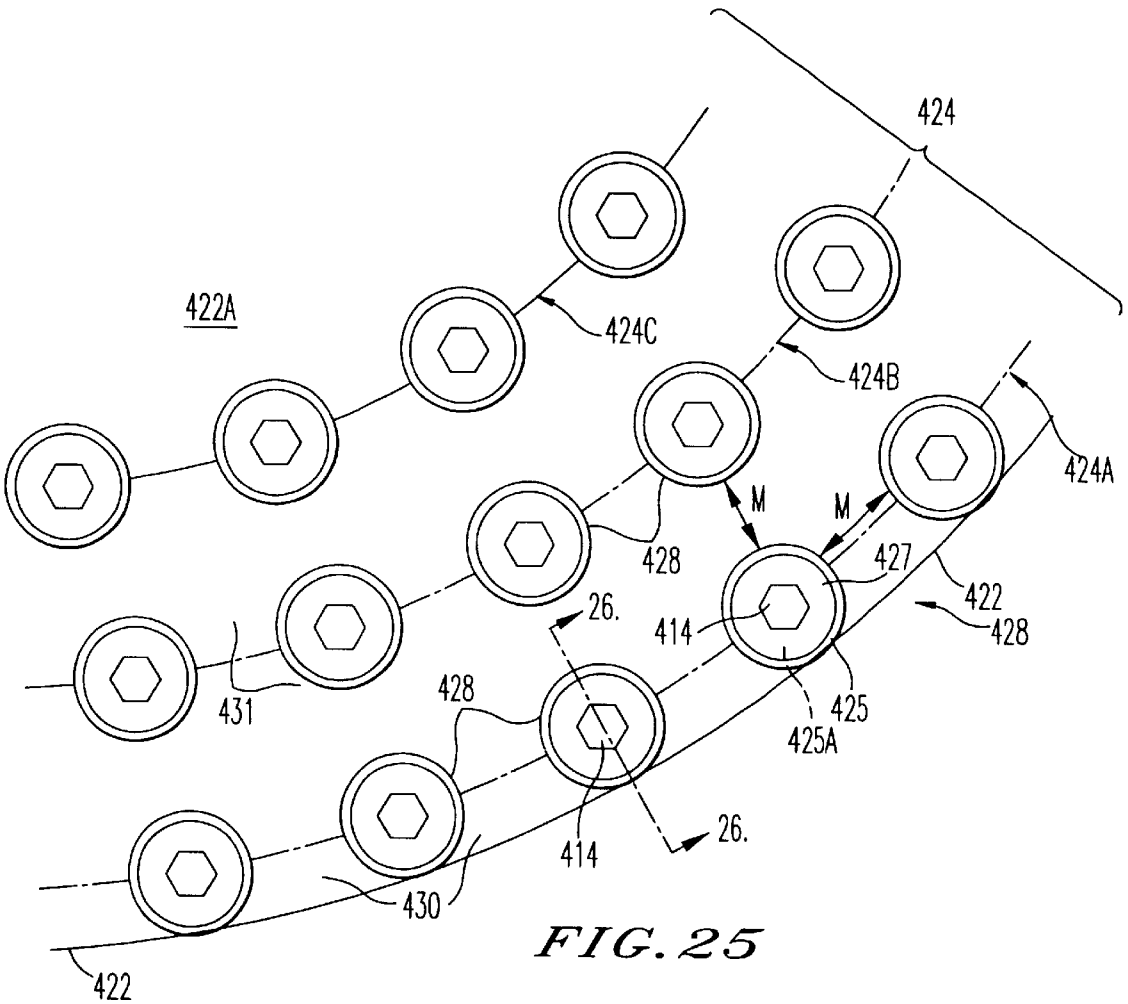
FIG. 25 is a partial enlargement of the abrasive grain layer of the wheel shown in FIG. 24.

At one-side 422*a* on base metal 422, as shown in FIG. 25, at each ring shaped domain of the first-third abrasive-grain-layer 424A, and B and C, plural mound parts 425 (protruded part) of mostly columnar form or mostly truncated cone form are formed toward the circumferential direction at predetermined intervals. And the concave part 426, which is caved mostly in cone shape, and formed on the center of the upper surface 425*a*. And the inner diameter D1 of the opening 426*a* at this concave part 426 is set as the size with smaller than the mean particle diameter of ultra abrasive grains 14. And the depth m is set mostly as ½ or less of the mean particle diameter of an ultra abrasive grain 14.

Therefore, the ultra abrasive grain 14, such as a single diamond or CBN is plugged in and adhered to this concave part 426, for example, dropped in about ¼–⅖ of mean particle diameter. And a part of ultra abrasive grain 14, which is covered by the metal binder phases 427 such as an electrodeposited metal phase of nickel or nickel alloy, is adhered at upper surface of 425*a* on the mound part 425, then constitutes the small abrasive-grain-layer part 428. In other word, the electrodeposited abrasive tool is formed adhering single ultra abrasive grain 14 427 on the mound part 425—with metal binder phase.

Figure 26:
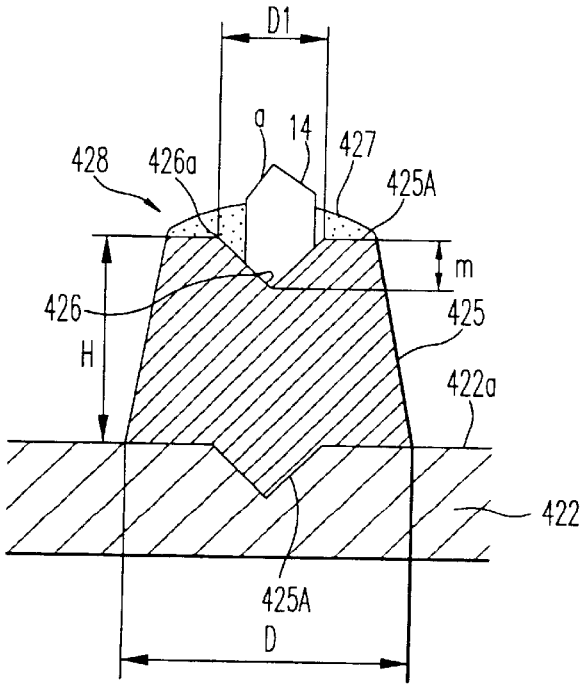
FIG. 26 is a sectional view at D—D line of the small abrasive-grain-layer parts of the wheel shown in FIG. 25.

Grinding point q which carries out the grinding to the grinding work piece is constituted as follows(refer to FIG. 26). By making narrowing sharp corner part or an acute part of an ultra abrasive grain 14 drop in to concave part 425, the corner part or the acute point at other countered ends will project up.

And at each of the first-third abrasive-grain-layer 424A, and B and C, the sub-discharge path 430, for example, is constituted between the mound parts 425, 425 which adjoin each other in the circumferential direction. An abrasive grain layer will not be formed in this sub-discharge path 430, then the grinding wastes of a pad 4, the solidification of slurry s, etc. will be discharged with grinding liquid. Furthermore, the mostly ring-like main discharge path 431 is formed at the diametric directed crevice among the first-third abrasive-grain-layer 424A, B, and C.

The main discharge path 431 and the sub-discharge path 430 are formed in the same depth for example. The grinding wastes at these main and sub discharge path 431,430 etc. will be discharged outside through the sub-discharge path 430 at the outermost first abrasive-grain-layer 424A.

Here, outer diameter D at the base of the mound part 425 is set within the range of 1.3 to 3 times as much as the mean particle diameter of an ultra abrasive grain 14. It is possible to prevent deposition of the grinding wastes at grinding point, and to wash them away smoothly within this limits. If smaller than 1.3 times, the strength of the mound part 425 falls, then ultra abrasive grain 14 will become easy to drop out by grinding resistance, and the mound part 425 will tend to suffer a loss. If larger than 3 times, the arrangement interval of an ultra abrasive grain 14 becomes too large, then a fault will arise that grinding capability will decline or the wear of ultra abrasive grain 14 will be set forward.

Moreover, the range of height H of the mound part 425 on one-side 422*a* of base metal 422 may be 0.05–3.0 mm.

Grinding liquid and grinding waste are poured easily and can be discharged between a grinding point and the main and sub discharge path 431,430 on a base metal 422 within this range. In addition, if the electrodeposited metal phase etc. is formed at one-side 422*a* of a base metal 422, the distance from this electrodeposited metal phase etc. will make height H.

Distance M between the mound parts 425,425 which adjoin each other in the direction of diameter and the circumferential direction is set in range as ⅓—twice of outer diameter D of the mound part 425. Within this range, grinding performance is secured, and the mound parts 425, 425 is made into the main discharge path 431 and the sub-discharge path 430, then grinding liquid and grinding wastes are poured easily and can be discharged. And if smaller than ⅓ time, although grinding performance is increased, grinding waste etc. becomes easy to be blocked, if larger than twice, grinding efficiency will decrease.

The wheel 420 according to this enforcement is constituted as mentioned above, subsequently and the manufacture method of a wheel 420 is explained in FIG. 27.

Figure 27A:
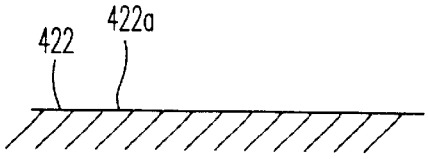
FIGS. 27(A), (B), (C), (D), and (E) are the figures showing the manufacturing process of the wheel according to the eleventh example of the present invention.
Figure 27B:
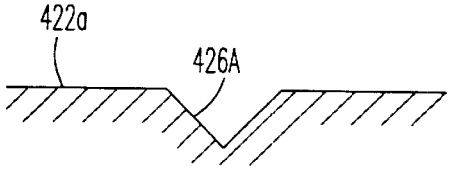

In FIG. 27(A), one-side 422*a* of the base metal 422 on the disk form which consists of SUS304 etc. is partially removed mostly in the shape of cone by etching or cutting, etc. As shown in (B) of this figure, dimple part 426A—is formed in the shape of ring at predetermined intervals, and moreover formed in three layers at intervals and in the direction of diameter, corresponding to the first-third abrasive-grain-layer 424A, B and C. In addition, dimple-part 426A—may be formed at one-side 422*a* by electrical discharge machining, model fabrication, etc. in stead of etching.

Figure 27C:
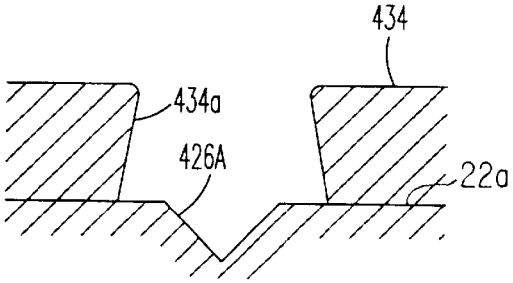
Figure 27D:
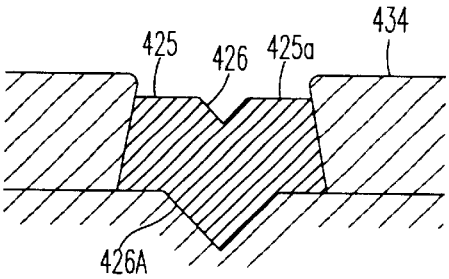

Subsequently as shown in FIG. 27(C), resin masking is carried out on one-side 422*a,* except for the domain equivalent to the mound part 425, which is around each dimple-part 426A. Nickel or nickel alloy is electroplated to dimple-part 426A and its circumference, and electroplate is deposited and upheaved. Thus many mound part 425—shown in FIG. 27(D) is formed at predetermined intervals respectively. In that case, a concave part 426 will be formed at upper surface 425*a* on the mound part 425, because electroplate is deposit to dimple-part 426A and its circumference with equal thickness.

Here in order to prepare electroplate formation of the mound part 425 in truncated cone shape, it should be controlled as follows. That side surface 434*a* of masking part 434 is arranged with inclination into truncated cone shape as to project toward outside along with projection from upper part of single-side 422*a* on base metal 422. Thus deposition domain is controlled. Moreover, the side surface 434*a* of the masking part 434 should be in the shape of erect cylinder in order to form the mound part 425 in an almost columnar.

And ultra abrasive grains 14 are dropped to concave part 426 on upper surface 425*a* of each mound part 425 with vibration for example. Since the diameter D1 of an opening of concave part 426 is set up smaller than the mean particle diameter of an ultra abrasive grains 14 in that case, the corner part or acute part of ultra abrasive grains 14 will drop in. And other corner parts or acute part, which are at mostly opposite position, project toward the position upper and tip side.

Figure 27E:
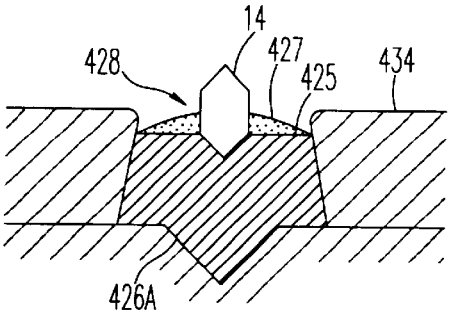

In case of abrasive grain electro-deposition in FIG. 27(E), other domains except for upper surface 425*a* on each mound part 425 is electroplated, i.e. the main and sub discharge path 431,430 etc. are masked with the resin masking part 434. In such way ultra abrasive grains 14 are adhered to upper surface 425*a* of each mound part 425 by the metal binder phases 427, such as nickel or nickel alloy. The amount of projection of the ultra abrasive grain 14 from the metal binder phase 427 becomes about ⅔–⅘ of mean particle diameter for example.

Figure 24:
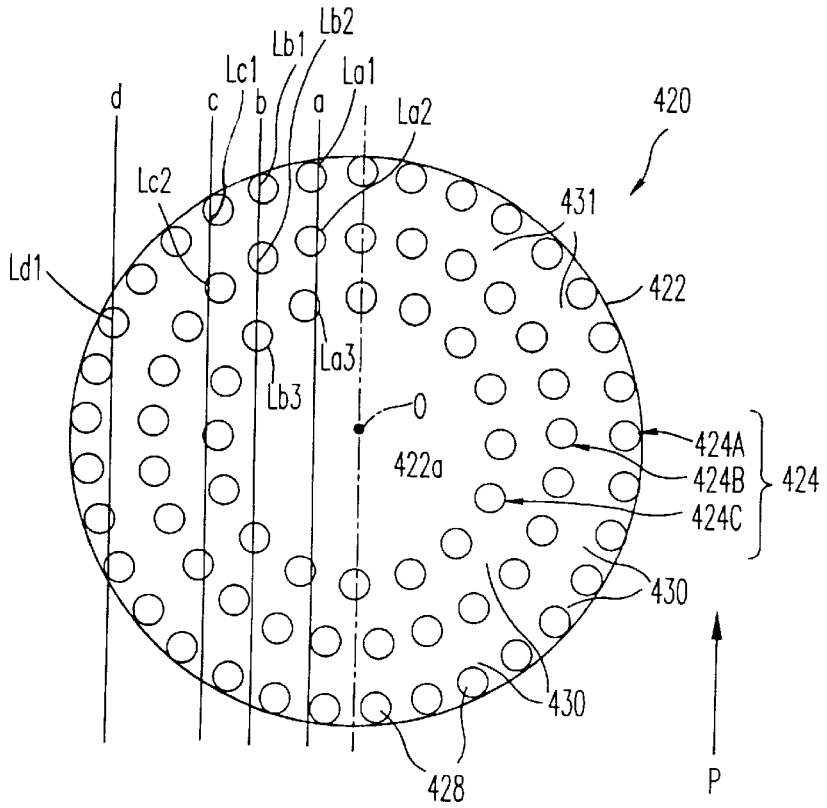
FIG. 24 is a plane view of the surface equipped with the abrasive grain layer of the wheel according to the eleventh example.

Also in the FIG. 24, the virtual line prolonged in the parallel direction toward rotation direction P of a pad 4 against the first-third abrasive-grain-layer 424A, and B and C is drawn as virtual lines a, b, c, and d in arbitrary positions shifted toward mostly rectangular direction to this direction. Then, like as the fourth embodiment mentioned above, the sum of each grinding length (area=work load) of the domain of the first-third abrasive-grain-layer 424A, and B and C, where each virtual lines a, b, c, and d cross, can be made almost uniform. Then grind machining with higher flatness can be carried out.

When the wheel 420 according to this embodiment is equipped with composition mentioned-above and the conditioning of a pad 4 is performed, grinding wastes of pad 4 produced by the grinding with ultra abrasive grain 14 at each small abrasive-grain-layer part 428, the wiring metal of a silicone wafer remained in pad 4, and grinding wastes of silicone, etc. are suppressed from being adhered and solidified among ultra abrasive grain 14. And viscosity of the grinding liquid containing these grinding wastes is reduced, and the discharge to the exterior is promoted through the sub-discharge path 430 and the main discharge path 431.

Furthermore, cooling of an ultra abrasive grain 14 is promoted and the damage of an ultra abrasive grain 14 is prevented with grinding liquid, and various grinding wastes can suppress carrying out self-possessed deposition among ultra abrasive grain 14 and 14.

Figure 28:
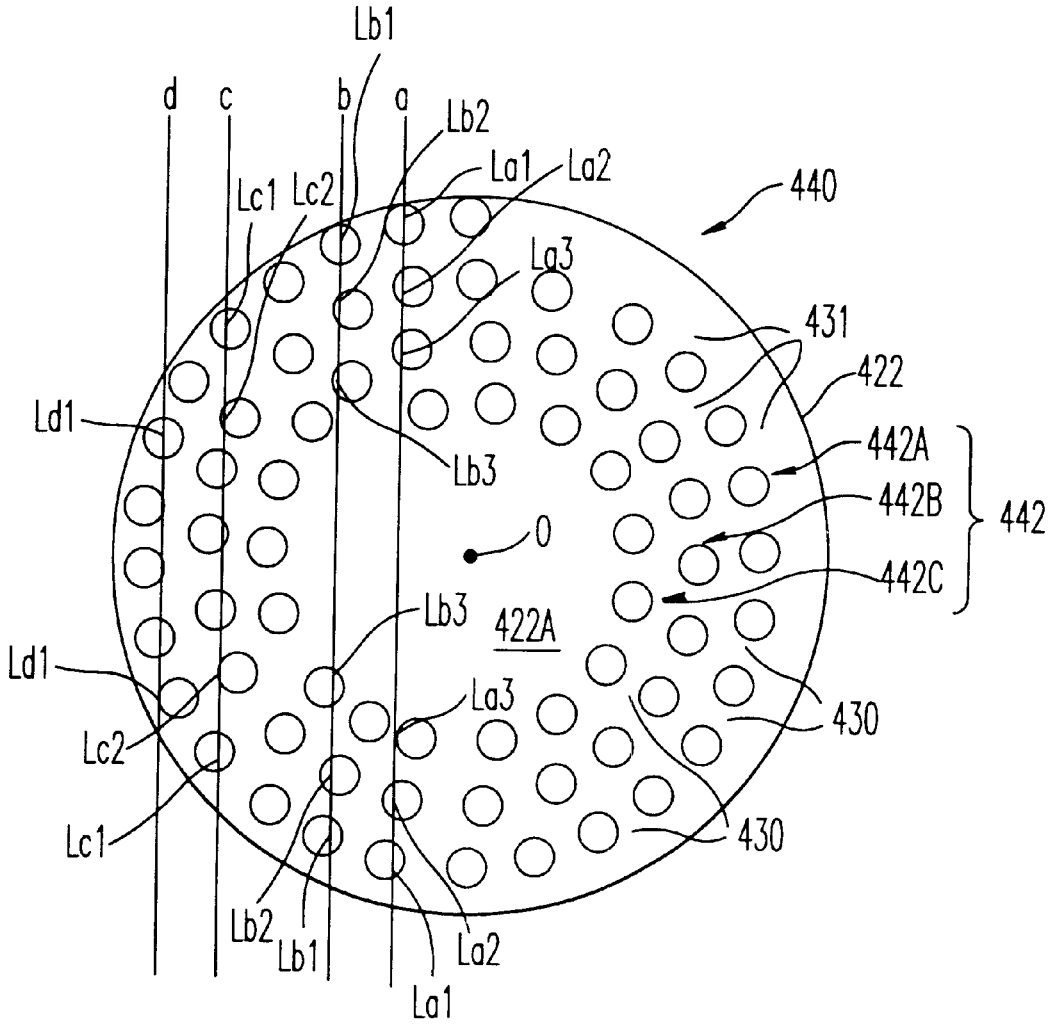
FIG. 28 is a plane view of the wheel according to the twelfth example.

Subsequently, the twelfth embodiment of the present invention is explained by FIG. 28, with omitting the explanation to the part and material the same as that of the eleventh embodiment mentioned above, using the same mark. The wheel 440 shown in FIG. 28 has the same composition as wheel 420 according to eleventh embodiment. Difference is that the abrasive grain layer 442, which is arranged with plural small abrasive-grain-layer parts 428—at predetermined interval is formed in continuous shape of a spiral of one layer. It is desirable that if abrasive grain layer 442 is formed at least in three layers, at an interval In the direction of diameter (formed in three layers in FIG. 28).

Also in this embodiment if abrasive grain layer 442 is considered as three layers turned inside from the outside direction of diameter, it is spirally and continuously formed one by one, as the first abrasive grain layer of the outermost circumference 442A, the second abrasive grain layer 442B, and third innermost abrasive-grain-layer 442C. The spiral main discharge path 431 is formed among each abrasive grain layer, and many sub-discharge-path 430—which pass through to the main discharge path 431 is formed among the small abrasive-grain-layer parts 428,428 of each abrasive grain layer.

Figure 29A:
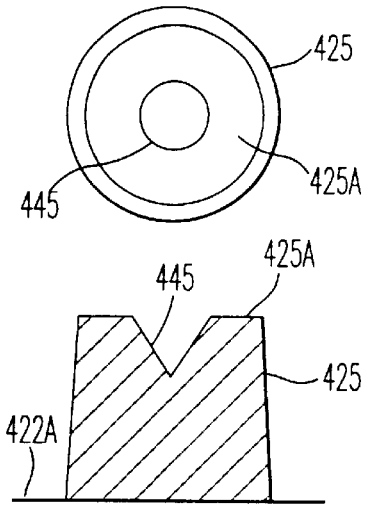
FIG. 29 shows the examples of modification of the protruded part of the small abrasive-grain-layer parts, (A) shows a plane view and a central longitudinal section view of the other protruded parts, and (B) shows the plane view and side view of another protruded parts.
Figure 29B:
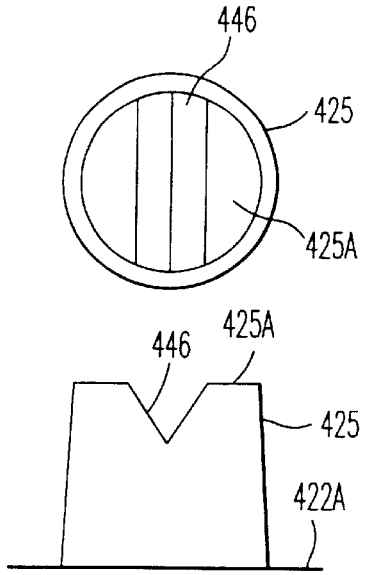

In addition, other concave parts 426 may be adopted in stead of the form mentioned-above embodiment about the mound part 425. For example, electroplate formation at the mound part 425 may be carried out in mostly truncated cone shape or mostly columnar shape, in stead of forming dimple-part 426A at one-side 422*a* on base metal 422, as shown in FIG. 29(A). After that, cone-shaped concave part 445 may be formed at the central part of upper surface 425*a*. Or V shaped concave part 446 may be formed of by cutting etc. in the direction of diameter of upper surface 425*a*, after forming the mound part 425. Moreover, the mound part 425 and the metal binder phase 427 may be formed with metal bond in stead of the forming method by electroplate etc. Or the mound par 425, model fabrication with that of base plate 422 may be adopted.

The electrodeposited abrasive wheel (electrodeposit abrasive tool) according to the 14th embodiment has been composed with the various form of embodiment mentioned-above. For example, it has the almost same composition as the electrodeposited abrasive wheel 20 shown in the first embodiment, and especially composed with 1 or plural blocky ultra abrasive grain adhered to the small abrasive-grain-layer part 24 on each protruded part 21 of a base metal 19 by the metal binder phase.

Figure 30A:
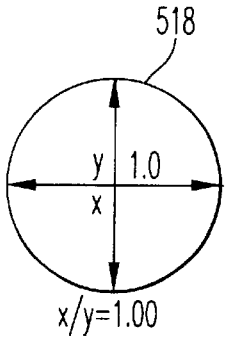
FIG. 30 shows the ratio of the diameter of the longest two symmetry axes on the image of ultra abrasive grains, which are projected two-dimensionally, (A), (B), and (C) show a blocky ultra abrasive grain, and (D) shows an irregular ultra abrasive grain.
Figure 30B:
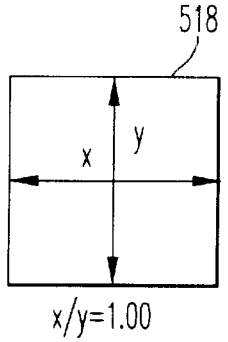
Figure 30C:
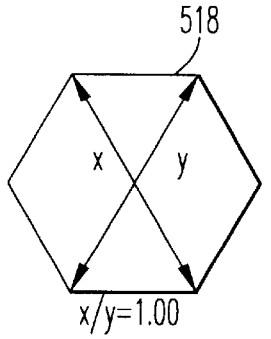
Figure 30D:
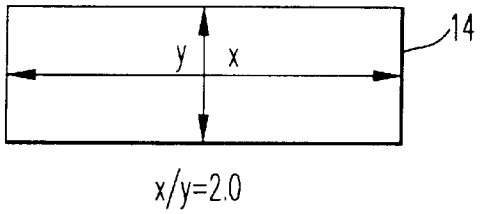

Here, a blocky ultra abrasive grain is referred as follows, as shown in FIGS. 30(A), (B), and (C), abrasive-grain image projected in 2 dimensions, that the ratios (eccentricity) y/x of x axis and y axis with the maximum size of two symmetry axes, are 1–1.2. and ultra abrasive grain of the form near regular polygons, such as parallelepiped or globular form, etc. On the other hand, irregular ultra abrasive grain is referred as that with the ratio of y axis and x axis is more than 1.2. For example, each ultra abrasive grain 518 shown in FIGS. 30(A), (B), and (C) is set to y/x=1.0, and the super-abrasive grain 14 shown (D)in this figure is set to y/x=2.0.

Figure 31:
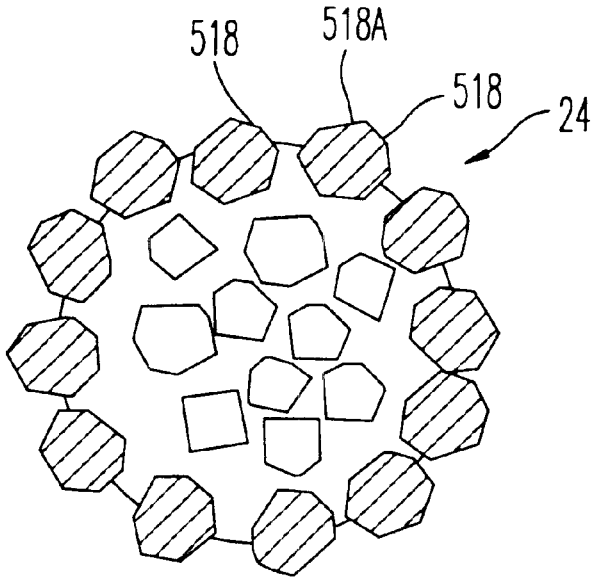
FIG. 31 is a plane view of the small abrasive-grain-layer parts shown in FIG. 30.
Figure 34:
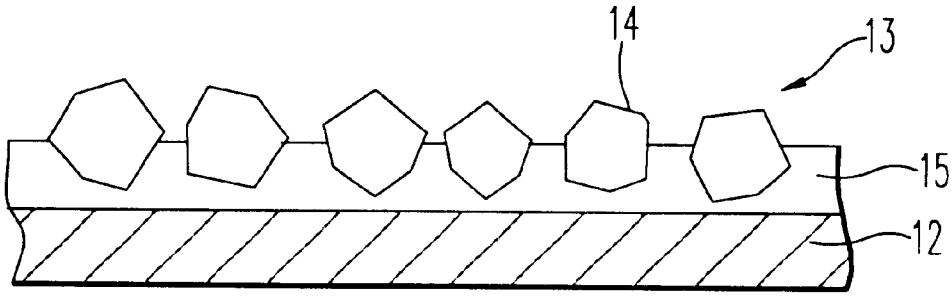
FIG. 34 is a partial longitudinal section of the abrasive grain layer shown in FIG. 33.

The ultra abrasive grain 518 are adhered to the whole surface electrodeposited abrasive wheel 20, for example of 1–500 pieces, and preferably, 11–500 range of ultra abrasive grains 518 are adhered by the electrodeposited metal phase 25. Moreover, as shown in FIG. 31, plural ultra-abrasive-grains 518—fixed to each small abrasive-grain-layer part 24 are arranged and adhered at least on plural ultra-abrasive-grain sequence 518A, arranged in the shape of ring at the perimeter side, only with the blocky ultra abrasive grain 518. And this ultra-abrasive-grain sequence 518A shall also contain the ultra abrasive grain 18, which is adhered at side 21*c* of protruded part 21, and also these shall be arranged only with the blocky ultra abrasive grain.

Therefore, the ultra abrasive grain at the inner side surrounded by ring-like ultra-abrasive-grain sequence 518A may include the irregular ultra abrasive grain. But all ultra abrasive grains may consist of blocky ultra abrasive grain 518 for the ease on manufacture.

When performing grinding using such an electrodeposited abrasive wheel 20, at each small abrasive-grain-layer part 24 of electrodeposited abrasive wheel 20, the rough grinding of pad 4 is performed with blocky ultra abrasive grain 518 first, at the corner R part. Then, finish grinding is performed with the ultra abrasive grain at the top part, which follows corner R part, and especially with blocky ultra-abrasive-grain sequence 518A at the perimeter of ultra-abrasive-grain 518—. Especially corner part, which turns to the outside of ultra-abrasive-grain sequence 518A of the perimeter, or ridgeline part, etc. can carry out grinding with moderate sharpness, without too much sharpness. Even if a scratch arises, it can be stopped as small one.

According to this embodiment as mentioned above, since the small abrasive-grain-layer part 24 was constituted from a blocky ultra abrasive grain 518—, grinding can be performed in good sharpness without too much sharpness at the portion of blocky ultra-abrasive-grain 518—turned to an outside, which is arranged on ultra-abrasive-grain sequence 518A at the perimeter by plane projection. Furthermore, sharp portion does not break and doesn't suffer chipping because irregular ultra abrasive grain is not used, and even if a scratch arises at grinding work piece, it will be stopped in small one. Furthermore, sharp portions, such as a corner part and a ridgeline part will not suffer crush at the time of grinding. Then it will not remain in pad 4 and the surface of grinding work pieces, such as a wafer, is not scraped, or a scratch is not formed, and a good mirror polish will be curried out.

Moreover, each electrodeposited abrasive wheel according to each above-mentioned embodiments may be used for carrying out grinding of pad 4, equipped on the wafer 5, and rotated at eccentric position against pad 4 in stead of conditioner 8.

Moreover, in the each embodiment mentioned above, mound part 21—and small abrasive-grain-layer part 24—are formed as almost columnar shape or in the shape of a rectangular parallelepiped. But the form of small abrasive-grain-layer parts or protruded parts should not be limited to these example, and should just have height H from the bottom of abrasive-grain-layer 22*a*, more than the mean particle diameter of ultra abrasive grain 14. For example, the shape of a convex curved surface, such as the shape of a hemisphere or triangular pyramid form will be sufficient.

Moreover, the electrodeposited abrasive wheels 20 and 30,120 and the wheel 220,240,—, etc., which constitute the abrasive tool according to each embodiment of the present invention, it is emphasized that other polish grinding equipments in addition to the conditioner used for CMP equipment, may be adopted.

What is claimed is:

1. An abrasive tool comprising a metal binder phase; and ultra abrasive grains, wherein the metal binder phase includes a base metal and an abrasive grain layer on the base metal;

the base metal includes a plurality of protruded parts formed in the base metal;

the abrasive grain layer includes small abrasive-grain-layer parts set at an interval mutually; and the ultra abrasive grains are adhered to the protruded parts by the small abrasive-grain-layer parts.

2. An abrasive tool according to claim 1, wherein said small abrasive-grain-layer parts are equipped with plural ultra abrasive grains, respectively.

3. An abrasive tool according to claim 1, wherein said small abrasive-grain-layer parts are prepared as the height from the bottom of abrasive-grain-layer among adjoining small abrasive-grain-layer parts is more than the mean particle diameter of ultra abrasive grains.

4. An abrasive tool according to claim 1, wherein said protruded parts are formed in almost columnar shape with corner R parts and the top parts, and ultra abrasive grains are arranged at these corners R parts and top parts.

5. An abrasive tool according to claim 1, wherein the ultra abrasive grains prepared at each said small abrasive-grain-layer parts are 11–500 pieces, and the rate which the ultra abrasive grains occupy against the whole area of said abrasive grain layer accounted by plane projection, is set at the range of 20%–80%.

6. An abrasive tool according to claim 1, wherein said small abrasive-grain-layer parts are arranged at the central domain except for the peripheral domain on the surface of abrasive grain layer.

7. An abrasive tool according to claim 1, wherein small abrasive-grain-layer parts are arranged at the peripheral domain except for the central domain on the surface of the abrasive grain layer.

8. An abrasive tool according to claim 1, wherein abrasive grain layer is equipped with a central domain and a outer peripheral domain, and plural said small abrasive-grain-layer parts are formed at an interval mutually at said central domain, and plural ultra abrasive grains are adhered at said small abrasive-grain-layer parts by the metal binder phase respectively, and ultra abrasive grain are fixed by the metal binder phase at said peripheral domain, and the degree of concentration of ultra abrasive grains is higher in the peripheral domain than said central domain.

9. An abrasive tool according to claim 1, wherein said small abrasive-grain-layers are prepared to form openings, which discharge grinding liquid, mostly at their center.

10. An abrasive tool according to claim 9, wherein the opening of said small abrasive-grain-layer parts are prepared within ϕ0.5–3.0 mm in diameter.

11. An abrasive tool according to claim 9, wherein the diameter of said protruded parts is prepared as 2–10 times of the diameter of said openings.

12. An abrasive tool according to claim 9, wherein discharge path is prepared among said abrasive grain layers laid out in the direction of diameter at an interval.

13. An abrasive tool according to claim 1, further comprising a discharge path formed at domains other than said small abrasive-grain-layer part.

14. An abrasive tool according to claim 1, wherein the height of the protruded parts against the bottom of said base metal is in the range of 0.1–5.0 mm.

15. An abrasive tool according to claim 1, wherein the distance between adjacent said protruded parts is in the range of ⅓–2 times of average diameter of protruded part.

16. An abrasive tool according to claim 1, wherein said abrasive grain layer is formed in plural layers of ring shape or spiral shape.

17. An abrasive tool according to claim 1, wherein only one layer of ultra abrasive grains are fixed in the thickness direction of metal binder phase at said small abrasive-grain-layer parts.

18. An abrasive tool according to claim 1, wherein said small abrasive-grain-layer parts have the first small abrasive-grain-layer parts which incline one-directionally against the diametrical central line passing through the center of base metal, and the second small abrasive-grain-layer parts which incline toward opposite direction.

19. An abrasive tool according to claim 18, wherein small abrasive-grain-layer parts with different aspect ratio are included at said first and second small abrasive-grain-layer parts, respectively.

20. An abrasive tool according to claim 18, wherein said small abrasive-grain-layer parts are dissociated mutually, and formed in mostly rhombus and arranged in the radial shape.

21. An abrasive tool according to claim 18, wherein said first and second small abrasive-grain-layer parts are arranged along circumferential direction of base metal by turns, and prepared in the shape of ring.

22. An abrasive tool according to claim 1,wherein said small abrasive-grain-layer parts have the portion incline one-directionally against the diametrical central line passing through the center of base metal, and the portion which incline toward opposite direction.

23. An abrasive tool according to claim 22, wherein the third and fourth small abrasive-grain-layer parts are prepared at which said small abrasive-grain-layer parts are formed in the shape of curve, and countered and faced on both sides of the diametrical central line, or shifted along with a central line.

24. An abrasive tool according to claim 1, wherein said small abrasive-grain-layer parts are arranged all over the base metal.

25. An abrasive tool according to claim 1, wherein a single ultra abrasive grain is adhered at said small abrasive-grain-layer parts by the metal binder phase.

26. An abrasive tool according to claim 25, wherein said small abrasive-grain-layer parts are formed by adhering ultra abrasive grain at concave parts formed at the upper surface of protruded parts on base metal.

27. A metal bonded single layer abrasive tool according to claim 25, wherein the outer diameter of said protruded parts is within the range of 1.3 to 3 times of the mean particle diameter of ultra abrasive grains.

28. An abrasive tool according to claim 25, wherein the height of the protruded parts against the bottom of said base metal is in the range of 0.05–3.0 mm.

29. An abrasive tool according to claim 25, wherein the distance between the adjacent said protruded parts is in the range of ⅓–2 times of the mean outer diameter of protruded part.

30. An abrasive tool according to claim 1, wherein said small abrasive-grain-layer parts are prepared by 1 or plural blocky ultra abrasive grain adhered by metal binder phase.

31. An abrasive tool according to claim 30, wherein plural ultra abrasive grains are adhered at said small abrasive-grain-layer parts, and the ultra abrasive grains at the perimeter side are blocky ultra abrasive grain.

32. An abrasive tool according to claim 30, wherein the ultra abrasive grains prepared at said small abrasive-grain-layer parts are 1–500 pieces, and the rate which ultra abrasive grains occupy to the whole area of said abrasive grain layer accounted by plane projection, is in the range of 2%–80%.

33. An abrasive tool according to claim 1, wherein said abrasive tool is CMP conditioner.

34. A method of making an abrasive tool, the method comprising joining ultra abrasive grains to a base metal using an abrasive grain layer; and producing the abrasive tool of claim 1.

* * * * *